US009416602B2

(12) United States Patent
Mosing et al.

(10) Patent No.: US 9,416,602 B2
(45) Date of Patent: Aug. 16, 2016

(54) APPARATUS AND METHODS FOR LIMITING MOVEMENT OF GRIPPING MEMBERS

(71) Applicant: Frank's International, LLC, Houston, TX (US)

(72) Inventors: Donald E. Mosing, Lafayette, LA (US); Jeremy Richard Angelle, Lafayette, LA (US); John Erick Stelly, Breaux Bridge, LA (US)

(73) Assignee: Frank's International, LLC, Houston, TX (US)

( * ) Notice: Subject to any disclaimer, the term of this patent is extended or adjusted under 35 U.S.C. 154(b) by 238 days.

(21) Appl. No.: 14/210,204

(22) Filed: Mar. 13, 2014

(65) Prior Publication Data

US 2014/0262341 A1 Sep. 18, 2014

Related U.S. Application Data

(63) Continuation-in-part of application No. 13/578,463, filed as application No. PCT/US2011/052768 on Sep. 22, 2011, now Pat. No. 9,194,192.

(60) Provisional application No. 61/403,829, filed on Sep. 22, 2010.

(51) Int. Cl.
*E21B 19/07* (2006.01)

(52) U.S. Cl.
CPC ..... *E21B 19/07* (2013.01)

(58) Field of Classification Search
None
See application file for complete search history.

(56) References Cited

U.S. PATENT DOCUMENTS 2,607,098 A * 8/1952 Wilson ..... E21B 19/10 188/67
4,915,177 A * 4/1990 Claycomb ..... E21B 17/1085 138/147
6,968,895 B2 11/2005 Mosing et al.
8,037,949 B2 10/2011 Juhasz et al.
2005/0051324 A1 3/2005 Mosing et al.
2009/0056930 A1* 3/2009 Angelle ..... E21B 19/07 166/77.51
2009/0056933 A1 3/2009 Campisi et al.
2009/0272542 A1 11/2009 Begnaud et al.
2010/0200215 A1 8/2010 Juhasz et al.

OTHER PUBLICATIONS

International Search Report from PCT/US2011/052768 dated Apr. 23, 2012 (3 pages).
International Preliminary Report on Patentability issued in PCT/US2011/052768, mailing date Apr. 4, 2013 (6 pages).

* cited by examiner

*Primary Examiner* — Jennifer H Gay
*Assistant Examiner* — Caroline Butcher
(74) *Attorney, Agent, or Firm* — Osha Liang LLP

(57) ABSTRACT

An apparatus to limit movement of gripping members relative to an elevator includes a locking arm coupled to the gripping members and a first engagement arm. The locking arm includes a set of teeth disposed longitudinally thereon, and the first engagement arm includes a first set of complimentary teeth configured to engage with the set of teeth of the locking arm. The first engagement arm is moveable between a disengaged position, in which the first engagement arm and the locking arm are relatively moveable, and an engaged position, in which the first engagement arm allows the locking arm to move in a first direction but prevents the locking bar from moving in a second direction by more than a selected distance. The teeth of the locking arm engage the first set of complimentary teeth of the first engagement arm when the first engagement arm is in the engaged position.

19 Claims, 16 Drawing Sheets

APPARATUS AND METHODS FOR LIMITING MOVEMENT OF GRIPPING MEMBERS

CROSS-REFERENCE TO RELATED APPLICATIONS

The present application is a continuation-in-part of U.S. patent application Ser. No. 13/578,463, filed Aug. 10, 2012. The '463 application is a national stage entry under 35 U.S.C. §371 from PCT Application Serial No. US/2011/052768 filed on Sep. 22, 2011. The '768 PCT application claims priority to U.S. Provisional Application Ser. No. 61/403,829, filed Sep. 22, 2010. The '463, '768 PCT, and '829 applications are all incorporated herein by reference in their entirety.

BACKGROUND

Elevators are generally employed in casing, drilling, and other wellbore operations to hoist and lower tubulars (e.g., casing or drill pipe) into the wellbore. The elevators may be coupled to a travelling block of the rig, and maneuvered to engage and hoist a tubular. The tubular is then brought into position and attached ("made up") to a lower tubular, which is already positioned in the wellbore, and then lowered. One common type of elevator employs slips that support the tubular by biting into or otherwise engaging the outer diameter of the tubular. Slip-type elevators generally include a "bowl" and several slips, which can be circumferentially spaced apart. When the elevator is disposed around a tubular, the slips can be lowered into the bowl, thereby adjusting the slips to move radially inward into engagement with the tubular. Downward force on the slips from the weight of tubular/tube string provides the gripping force for the slips.

This arrangement has proven effective in a variety of different applications. However, during running operations, it is not uncommon for the tube string to catch on a wellbore impediment. The rig operators may be unaware of the instant such catching occurs, and thus the elevator may continue to be lowered as the tube string is temporarily supported on such an impediment. Accordingly, the elevator may be relieved of the weight of the tube string, which, as noted, the elevator uses to provide the gripping force. This situation can lead to a drop of the tube string, which can be costly, or even catastrophic, to wellbore operations.

Attempts to address this potential have met with challenges. For example, existing devices useable to lock elevator slips into place generally require one or more manual adjustments and/or calibrations prior to use, to accommodate the diameter of the elevator and/or the tubular to be gripped. This introduces an additional potential for human error, takes valuable time in the running process, and generally does not permit lowering of the slips to engage a tubular while the locking devices themselves are operatively engaged.

What is needed, therefore, is an improved apparatus and method for limiting slip movement in an elevator.

SUMMARY

Embodiments of the disclosure may provide an exemplary apparatus for limiting movement of gripping members relative to an elevator. The apparatus may include a locking arm coupled to one or more of the gripping members and configured to move in a first direction when the gripping members move toward engagement with a tubular and to move in a second direction when the gripping members move away from engagement with the tubular. The apparatus may also include a first engagement member configured to move between a disengaged position, in which the first engagement member and the locking arm are relatively moveable, and an engaged position, in which the first engagement member allows the locking arm to move in the first direction but restrains the locking arm from moving in the second direction by more than a selected distance.

Embodiments of the disclosure may further provide an exemplary apparatus for gripping a tubular. The apparatus may include an annular body defining a longitudinal bore configured to receive the tubular therethrough, and slips disposed at least partially in the longitudinal bore, the slips being moveable radially and longitudinally into and out of engagement with the tubular. The apparatus may also include a locking arm coupled to one or more of the slips and configured to move in a first direction when the slips move toward engagement with the tubular and to move in a second direction when the slips move away from engagement with the tubular. The apparatus may further include a first engagement member configured to move between a disengaged position, in which the first engagement member and the locking arm are relatively moveable, and an engaged position, in which the first engagement member allows the locking arm to move in the first direction but restrains the locking arm from moving in the second direction by more than a selected distance.

Embodiments of the disclosure may also provide an exemplary method for limiting movement of slips of an elevator relative to the elevator. The method may include moving the slips into engagement with a tubular, wherein moving the slips requires a locking arm to move. The method may also include engaging the locking arm with a first engagement member. Engagement between the locking arm and the first engagement member permits movement of the locking arm in a first direction and provides an end range for movement of the locking arm in a second direction, to limit movement of at least one of the slips relative to the elevator.

DETAILED DESCRIPTION

Figure 1:
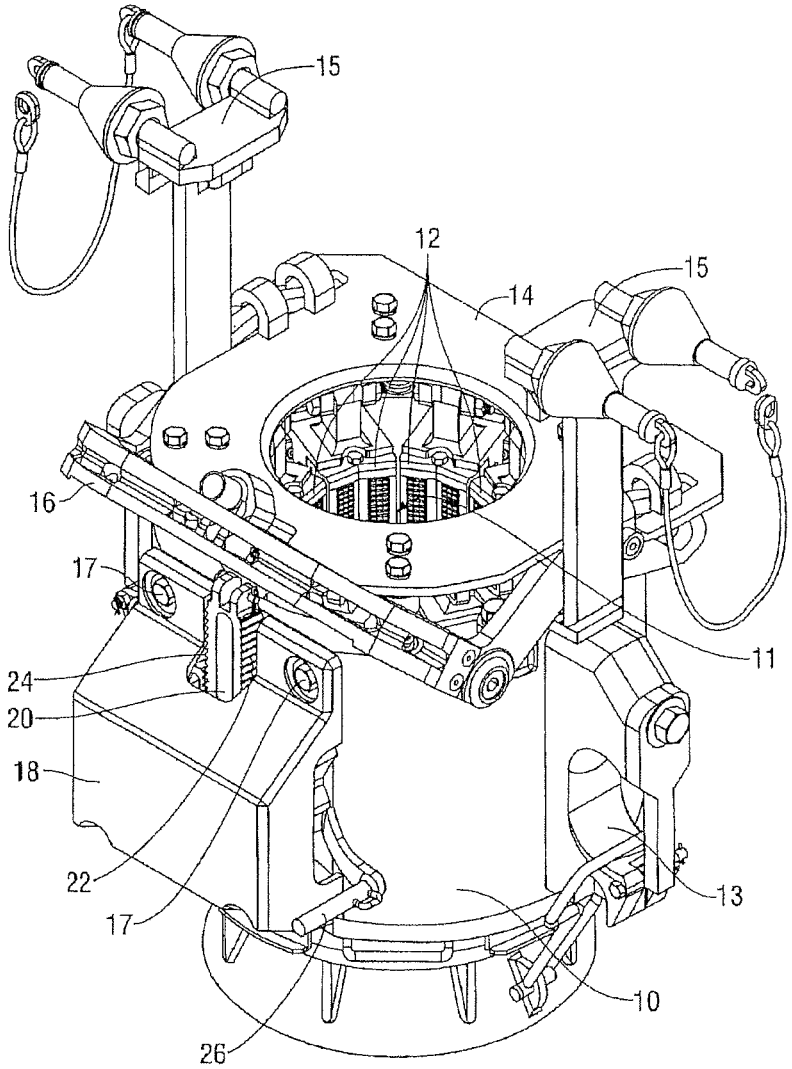
FIG. 1 illustrates a perspective view of an exemplary elevator, according to one or more embodiments described.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

FIG. 1 illustrates a perspective view of an elevator 1, having a generally annular elevator body 10 defining a longitudinal bore 11. The elevator 1 has one or more gripping members or "slips" 12 disposed at least partially therein. Although not individually labeled, the slips 12 may include a body and/or retainer movable into and from a bowl-shaped region of the elevator body 10 to engage and disengage a tubular, respectively. The body and/or retainer of each slip 12 may include teeth, marking gripping surfaces, non-marking gripping surfaces, shoulders, combinations thereof, or may receive an insert including such teeth, surfaces, and/or shoulders for engagement with the tubular (not shown). In other exemplary embodiments, however, the elevator 10 may not include slips and thus may be configured to otherwise engage, hoist, and lower a tubular or may be another type of running tool or gripping device.

The elevator 1 may further include ears 13 and stabilizing members 15 for engaging bails (not shown) and orienting and/or moving the elevator 1. The elevator 1 may be positioned with a tubular (not shown) received through the bore 11. The slips 12 may be moveable radially and/or longitudinally in the bore 11. For example, the slips 12 may be movable between a lowered, engaged position, where they may engage a tubular (not shown), and a raised, disengaged position, where the slips 12 may allow independent movement between the elevator 1 and the tubular. The slips 12 may be moved between the engaged and disengaged positions manually or through any remote, hydraulic, pneumatic, or electrical devices and methods. Further, the elevator 1 may also include a timing ring 14 coupled to the slips 12, such that movement of the timing ring 14 moves the slips 12. The timing ring 14 may in turn be coupled with a yoke 16, which may be manually, remotely, etc. manipulated to raise and/or lower the timing ring 14, thereby raising and/or lowering the slips 12.

The elevator 1 also includes an exemplary apparatus 2 for limiting movement of the slips 12 relative to the elevator 1. The apparatus 2, or at least portions thereof, may be fastened to the elevator body 10 using bolts 17, however other methods and devices of coupling, such as fastening with other types of fasteners (e.g., pins or rivets), welding, brazing, adhering, or integral forming, may also be used in lieu of in addition to the depicted bolts 17. The apparatus 2 includes a cover or housing 18, from which a locking arm 20 extends to engage the yoke 16. For example, movement of the slips 12, and thus the timing ring 14 and yoke 16, may cause movement of the locking arm 20, and vice versa. More particularly, in at least one exemplary embodiment, movement of the slips 12 downward with respect to the body 10 to engage a tubular may require upward movement of the locking arm 20 through the connection between the locking arm 20 and the yoke 16, while upward movement of the slips 12 relative the body 10 (i.e., away from the elevator bowl) may require downward movement of the locking arm 20.

The locking arm 20 may include two or more sets of teeth; for example, first and second sets of teeth 22, 24, disposed on opposite longitudinal sides of the locking arm 20, as shown. An actuation member, e.g., a handle 26, may also extend from the housing 18. The handle 26 may be coupled with the slips 12, the timing ring 14, and/or the yoke 16, such that actuation of the depicted apparatus 2 using the handle 26 may cause or prevent movement of the slips 12, as will be described in greater detail below. Other remote, hydraulic, pneumatic, and/or electrical devices or methods for actuation, in addition to or in lieu of the manual handle 26, may be used to engage and disengage the apparatus.

Figure 2:
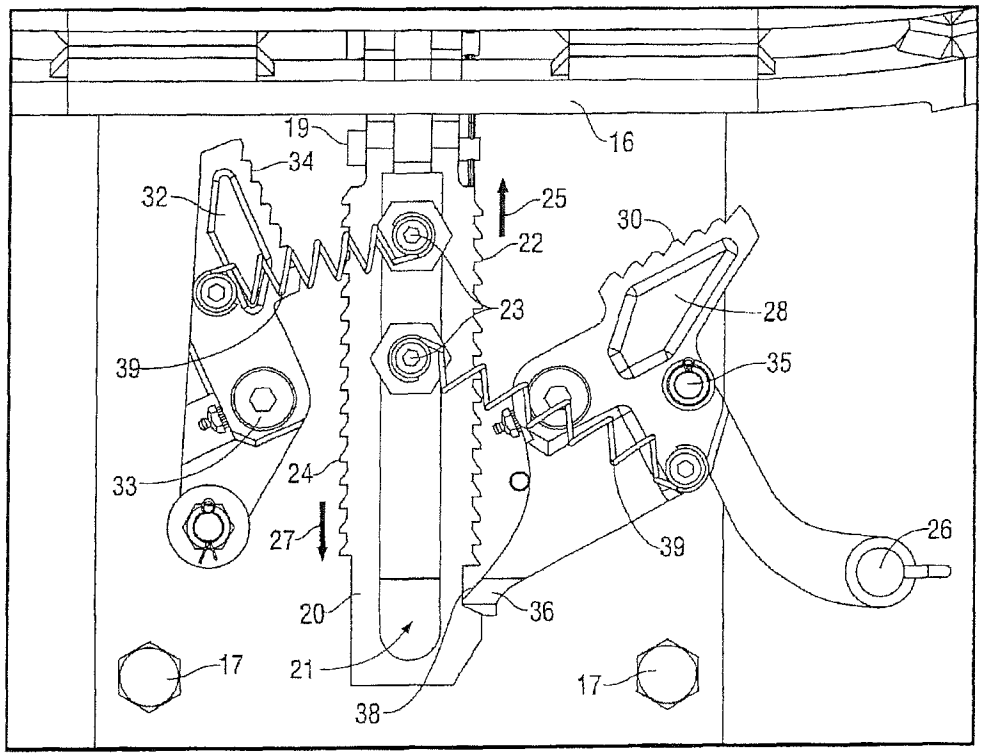
FIG. 2 illustrates a front view of an exemplary apparatus for limiting movement of slips of an elevator, according to one or more embodiments described.

With continuing reference to FIG. 1, FIG. 2 illustrates a front view of the exemplary apparatus 2, according to an embodiment, with the housing 18 removed for illustrative purposes. The locking arm 20 is shown engaged with the yoke 16, as described above, such that movement of the slips 12 downward with respect to the elevator body 10 to engage a tubular causes the yoke 16 and thus the locking arm 20 to move in a first or "upward" direction 25. Further, movement of the slips 12 upward with respect to the elevator body 10 causes the yoke 16 and thus the locking arm 20 to move in a second or "downward" direction 27. To reiterate, it will be appreciated that directional language such as "upward" or "downward" as used herein is not intended to be limiting, but is instead conveniently used to indicate a relative positioning or direction among elements, as shown in the drawings.

A fastener such as a pin 19 may be engaged through complementary orifices within the yoke 16 and/or locking arm 20. Although not shown, in another exemplar embodiment, a protrusion of one of the yoke 16 and the locking arm 20 may engaged the other through a complementary orifice (not shown). Further, the locking arm 20 may have a central slot or orifice 21 through which two or more fasteners, e.g., bolts 23 may secure the locking arm 20 to the elevator body 10. Movement of the locking arm 20 in the upward and downward directions 25, 27 relative to the elevator body 10 and the bolts 23 is thereby permitted and guided by the engagement of the bolts 23 through the slot 21.

The apparatus 2 may also include one or more engagement members or "arms" (two shown: 28, 30). The engagement arms 28, 30 may also be referred to as a contacting, gripping, and/or movement-limiting member. In an exemplary embodiment, the first engagement arm 28 may include a first set of complementary teeth 30, and the second engagement arm 32 may include a second set of complementary teeth 34. The engagement arms 28, 32 may be pivotally coupled to the elevator body 10, such that the engagement arms 28, 32 can selectively engage or disengage from the locking arm 20. Accordingly, the engagement arms 28, 32 may be coupled to the elevator body 10 using a pivot pin 33 or the like. In other embodiments, the engagement arms 28, 32 can be linearly moveable, rather than, or in addition to, being pivotally movable.

Further, the handle 26 may be coupled to the first engagement arm 28 to enable movement thereof between engaged and disengaged positions. A connecting member (shown in and described below with reference to FIGS. 3 and 4) may be used to connect the first and second engagement arms 28, 32 such that use of the handle 26 to move the first engagement arm 28 between effects a corresponding movement of the second engagement arm 32. In other embodiments, two or more handles 26, e.g., one for each engagement arm 28, 32, may be employed to independently move each of the engagement arms 28, 32. Further, in embodiments including more than two engagement arms, a single or multiple handles 26 may be employed, with each handle coupled to one, two, or more engagement arms 28, 32. Moreover, it although the engagement arms 28, 32 are shown to be moveable (e.g., pivotal) with respect to the locking arm 20, in other embodiments, the locking arm 20, the elevator body 10, or other parts of the apparatus 2 and/or elevator 1 may be movable to cause contact between the engagement arms 28, 32 and the locking arm 20.

The first engagement arm 28 may have an extension 36, which engages a corresponding notch 38 in the locking arm 20 to maintain the engagement arms 28, 32 in a disengaged position. In an exemplary embodiment, engagement between the extension 36 and the notch 38 can maintain the slips 12 in a disengaged position by preventing movement of the locking arm 20 in the downward direction 27. In another embodiment, the slips 12, timing ring 14, and/or yoke 16 may be otherwise coupled to the handle 26. Moreover, the engagement arms 28, 32 may be biased toward the locking arm 20, such that when the extension 36 is disengaged from the notch 38, the engagement arms 28, 32 is urged toward, e.g., into engagement with, the locking arm 20. Such biasing may be effected by resilient, coiled tension springs 39, as shown. The springs 39 can be engaged with the bolts 23, the locking arm 20, or another portion of the apparatus to bias the engagement arms 28, 32 toward the locking arm 20. In other embodiments, biasing force may be supplied by any biasing device, such as one or more leaf springs, torsion springs, compression springs, elastic bands, hydraulic actuators, electromechanical actuators, mechanical linkages, combinations thereof and/or combinations with the illustrated coiled tension springs 39, or the like.

It will be appreciated that while FIG. 2 depicts an arrangement of components in which the locking arm 20 moves in upward and downward directions 25, 27 concurrent with movement of the slips 12 in a generally opposing direction, this is but one example among many contemplated herein. For example, other embodiments may employ gears, biasing members, connectors, etc., such that the locking arm 20 can be configured to move in the same direction as the slips 12 or in any other desired directions when the slips 12 are moved toward or away from engagement with a tubular.

Moreover, in an exemplary embodiment, rather than being linearly moveable, the locking arm 20 may be a rotatable gear, configured to rotate according to slip 12 movement. In such an embodiment, the locking arm 20 may be configured to rotate in a first direction when the slips 12 move toward engagement with the tubular and configured to rotate in the opposite direction when the slips 12 move away from engagement with the tubular. As such, the engagement members 28, 30 may be configured to allow the rotation in the first direction, but generally prevent rotation in the opposite direction, when engaged.

Figure 3:
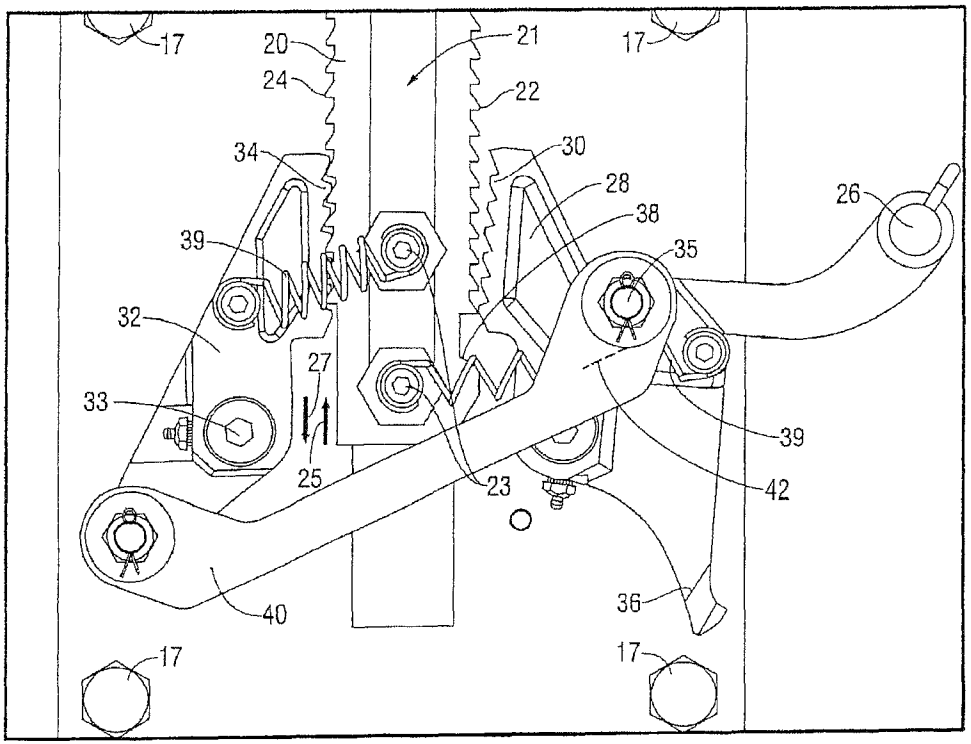
FIG. 3 illustrates a front view of the apparatus of FIG. 2 in an engaged position, according to one or more embodiments described.

FIG. 3 illustrates a partial front view of the exemplary apparatus 2 in an engaged position, according to an embodiment. As shown, the engagement arms 28, 32 have been pivoted about the pin connections 33 from the disengaged position shown in FIG. 2, such as through movement of the handle 26 and/or use of biasing members 39, to disengage the extension 36 from the notch 38. While the depicted apparatus 2 is in the engaged position, the complementary teeth 30 of the first engagement arm 28 are received between at least some of the first set of teeth 22 of the locking arm 20, and the complementary teeth 34 of the second engagement arm 32 are received between at least some of the second set of teeth 24 of the locking arm 20. A connecting member 40, as referenced above, is shown engaged to both the first and second engagement arms 28, 32 via bolt or pin connections 35, for example, such that movement of the first engagement arm 28 between engaged and disengaged positions precipitates movement of the second engagement arm 32 between engaged and disengaged positions.

The teeth 22, 24 of the locking arm 20 may have a generally wedge-shaped and/or triangular profile, having a steeply angled upper surface, and a generally straight and/or slightly angled lower surface. The complementary teeth 30, 34 of the engagement anus 28, 30 are shown having a generally wedge-shaped and/or triangular profile with a steeply angled lower surface and a generally straight and/or slightly angled upper surface. Thus, while the teeth 30, 34 of the engagement arms 28, 32 are in contact with the locking arm 20, movement of the locking arm 20 in the upward direction 25, corresponding to downward movement of the slips 12 to engage a tubular, is permitted, as the teeth 22, 24 of the locking arm 20 slide over the complementary teeth 30, 34 of the engagement arms 28, 32.

Further, the connecting member 40 may have a groove, slot, or similar elongate orifice 42 at the point of attachment with the first engagement arm 28, to permit a range of independent movement of the engagement arms 28, 32 along the locking min 20 during this movement. For example, the groove 42 can be sized to permit lateral movement of the first engagement arm 28 caused by contact between the complementary teeth 30 thereof and the teeth 22 of the locking arm 20, without transmitting this movement to the second engagement arm 32. The groove 42 can also permit movement of the second engagement arm 32 independently of the first engagement arm 28 in a similar manner.

While the teeth 30, 34 of the engagement arms 28, 32 are in contact with the locking arm 20, movement of the locking arm 20 in the downward direction 27, corresponding to upward, disengaging movement of the slips 12 relative to the elevator body 10 (FIG. 1) may be limited through abutment between the generally straight and/or slightly angled surfaces of one or more sets of teeth 20, 24, 30, 34. As shown in FIG. 3, while the complementary teeth 30, 34 of the engagement arms 28, 32 contact the teeth 22, 24 of the locking arm 20, neither set of complementary teeth 30, 34 is interlocked with the corresponding teeth 22, 24 of the locking arm (20), e.g., the generally straight and/or slightly angled surfaces of the teeth are not shown in abutment. Thus, a small downward movement of the locking arm 20 may be allowed before the second set of teeth 24 are interlocked with the complementary teeth 34 of the second engagement arm 32.

Figure 4:
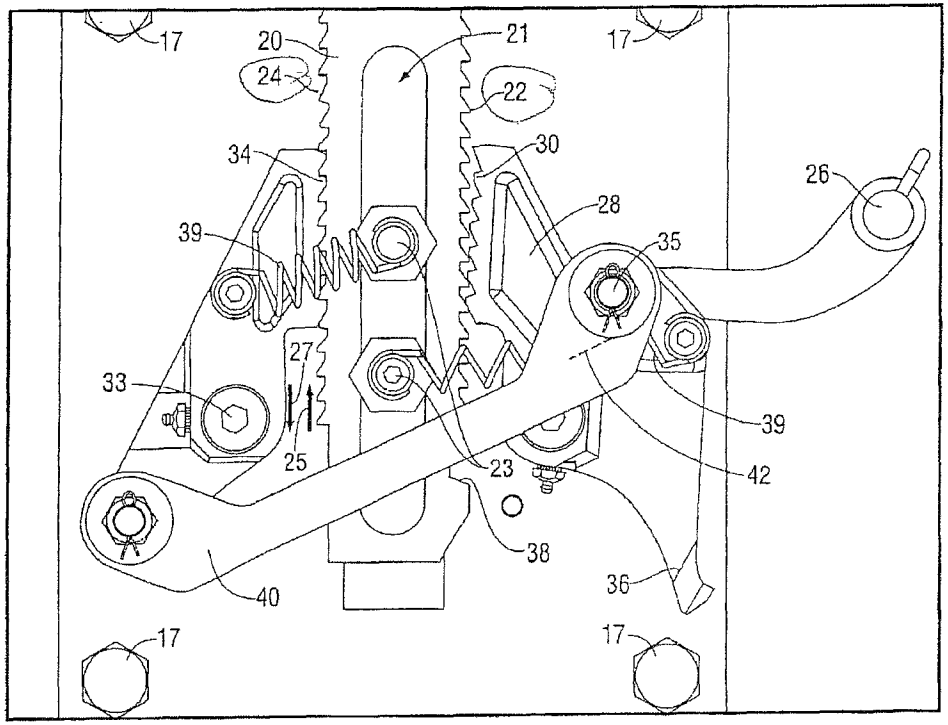
FIG. 4 illustrates a front view of the apparatus of FIGS. 2 and 3 in an interlocked position, according to one or more embodiments described.

FIG. 4 illustrates a partial front view of the exemplary apparatus 2 of FIGS. 2 and 3, according to an embodiment, in an interlocking position after the allowed small downward movement of the locking arm 20, corresponding to a small upward movement of the slips 12 (FIG. 1). The teeth 34 of the second engagement arm 32 are interlocked with the second set of teeth 24 of the locking arm 20, such that the generally straight and/or slightly angled lower surfaces of the second set of teeth 24 abut the generally straight and/or slightly angled upper surfaces of the complementary teeth 34, thereby preventing further movement of the locking arm 20 in the downward direction 27. While the specific point along the locking arm 20 contacted by the engagement arms 28, 32 may vary depending on the dimensions of the elevator 1, the slips 12, and/or the tubular (not shown), it should be noted that the maximum distance the locking arm 20 travels before achieving an interlocked position with one of the engagement arms 28, 32, as shown in FIG. 4, may depend upon the spacing between the teeth 22, 24, 30, 34.

Moreover, the first set of teeth 22 may be longitudinally offset (i.e., staggered) with respect to the second set of teeth 24. For example, the second set of teeth 24 may be positioned below the corresponding teeth on the first set of teeth 22 by a distance of about one-half the pitch (i.e., the distance between corresponding points of two adjacent teeth) of the teeth 22 and/or 24. In a specific example, the teeth 22, 24 may have a pitch of about 0.5 inches, and the second set of teeth 24 may be offset from the first set of teeth 22 by about 0.25 inches. In other exemplary embodiments, the offset distance may range from a low of ⅕, about ¼, or about ⅓ of the pitch to a high of about ¾, about ⅘, or about of the pitch. Alternatively or additionally, in another embodiment, the first and second engagement members 28, 32 may be longitudinally offset, such that the teeth 30, 34 thereof are likewise offset.

With the engagement arms 28, 32 in the engaged position, a selected maximum distance or end range may be provided for downward movement of the locking arm 20 relative to the engagement arms 28, 32 before one of the sets of teeth 22, 24 becomes interlocked with the corresponding set of complementary teeth 30, 34. For example, the selected distance may be approximately one-half the pitch of the teeth 22 and/or 24 (e.g., 0.25 inches). Thus, through use of two sets of vertically offset teeth 22, 24, the permitted movement of the locking arm 20 may be limited in a manner substantially similar to the movement that would be permitted were a single set of teeth provided with closer spacing. The larger pitch allowed, however, enables the teeth 22, 24, 30, 34 to be thicker and thus of a more robust construction. Although the depicted embodiment includes two engagement arms 28, 32 adapted for engagement with two corresponding sets of teeth 22, 24 being offset by a selected distance, the apparatus 2 may include any number of engagement arms, including a single engagement arm, with the teeth having any desired pitch and, in multiple engagement arm embodiments, with any desired offset, including no offset, between the engagement arms.

In exemplary operation, the apparatus 2 is actuated, such as through use of the handle 26, removing the extension 36 from the notch 38 and causing at least one engagement arm 28, 32 (e.g., both) to contact the locking arm 20. The slips 12 can be lowered into the elevator body 10 before actuating the apparatus, after actuating the apparatus, or simultaneously therewith. In an exemplary embodiment, engagement between the extension 36 and the notch 38 can retain the slips 12 in a raised position, e.g., through the attachment of the slips 12 to the locking arm 20 via the timing ring 14 and yoke 16. Independent of the time at which the apparatus 2 is actuated, downward movement of the slips 12 into the elevator body 10 to engage a tubular may be permitted due to the shape of the teeth 22, 24, 30, 34, which may be adapted to allow movement of the locking arm 20 in an upward direction 25 relative to the engagement arms 28, 32. Should upward movement of the slips 12 be attempted while the apparatus 2 is engaged, the slips 12 may be permitted to move a small distance away from the elevator body 10, causing the locking arm 20 to travel in the downward direction 27 until the one or more sets of teeth 22, 24 along the locking arm 20 are interlocked with complementary teeth 30, 34 of one or more engagement arms 28, 32.

This interlocking engagement prevents further movement of the locking arm 20, preventing further movement of the slips 12.

In an embodiment, the permitted movement of the slips 12 may not be sufficient for the slips 12 to drop the shaft (i.e., a generally constant diameter portion of the tubular extending from or to a radially-protruding collar, or between two radially-protruding collars). In another embodiment, the movement of the slips 12 may allow the slips 12 to drop the shaft of the tubular; however, the embodied apparatus 2 can limit upward movement of the slips 12 to a distance insufficient to permit the collar of the tubular from passing through the bore 11 of the elevator body 10. Thus, the collar of a released tubular may impact the upper surface of the slips 12, resetting the slips 12 into the elevator body 10. Accordingly, this may enable the slips 12 to again engage the tubular, thereby transferring the weight of the tubular string to the elevator 1. In still another embodiment, the slips 12 may be configured to engage a collar of the tubular during normal operation. As such, the radially-outward movement of the slips 12 allowed by the apparatus 2 may be insufficient for the slips 12 to release and fit over the collar.

Figure 5:
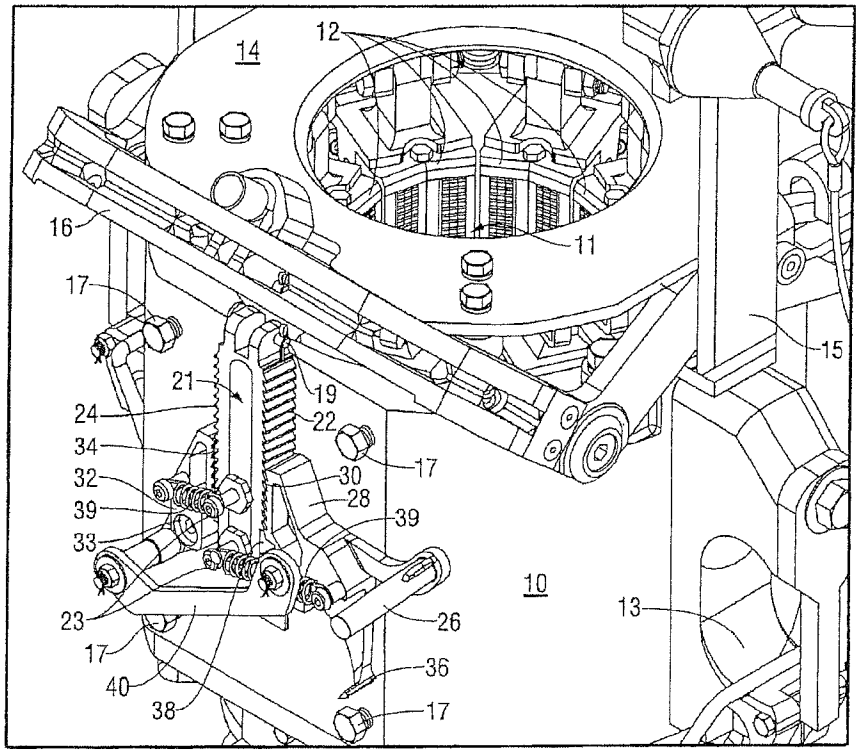
FIG. 5 illustrates a perspective view of an elevator including the apparatus of FIGS. 2-4, with the apparatus and the slips in an engaged position, according to one or more embodiments described.

FIG. 5 illustrates a perspective view of an elevator 1 with the exemplary apparatus 2 coupled to the elevator body 10, and being disposed in an engaged position. The slips 12 may also be in an engaged or lowered position to engage a tubular (not shown). The timing ring 14 may be coupled to the slips 12 to enable movement thereof. The yoke 16 may be engaged with the timing ring 14 to enable manual raising of the slips 12 and to provide a point of attachment with the locking arm 20 of the apparatus 2 via the depicted pin 19 or a similar manner of engagement.

The engagement arms 28, 32 are shown in the engaged position relative to the locking arm 20, as described above with reference to FIG. 4. In the engaged position, the complementary teeth 30 of the first engagement arm 28 contact the first set of teeth 22 of the locking arm 20, and the complementary teeth 34 of the second engagement arm 32 contact the second set of teeth 24 of the locking arm 20. When the apparatus 2 is engaged as shown, movement of the locking awl 20 in an upward direction, corresponding to movement of the slips 12 downward into the elevator body 10 for engagement with a tubular will be permitted, while movement of the locking arm 20 in a downward direction, corresponding to movement of the slips 12 upward relative to the elevator body 10, is limited through engagement between abutting sets of teeth 22, 24, 30, 34.

Figure 6:
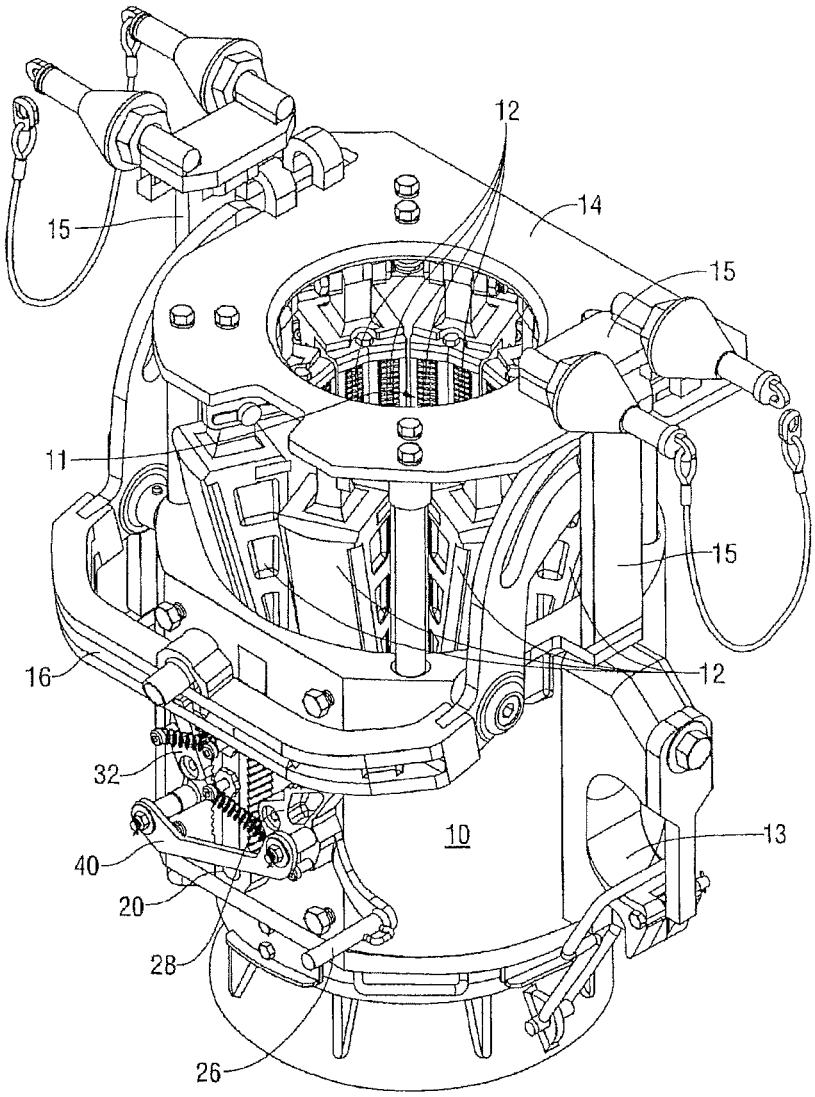
FIG. 6 illustrates a perspective view of the elevator and apparatus of FIG. 5, with the apparatus and the slips in a disengaged position, according to one or more embodiments described.

FIG. 6 illustrates a perspective view of the elevator 1 and apparatus 2, with the apparatus and the slips 12 of the elevator 1 in a disengaged position. Specifically, the timing ring 14 and slips 12 are shown in a raised position to permit passage of tubulars through the elevator body 10, while the yoke 16 and locking arm 20 are shown in a lowered position. The engagement arms 28, 32 are shown, connected by the connecting arm 40, and pivoted such that the complementary teeth 30, 34 do not contact the locking arm 20, thus permitting movement of the locking arm 20 in both upward and downward directions. The extension 36, (FIG. 5) can be engaged with the notch 38 (FIG. 5) to secure the locking arm 20 and consequently, the slips 12 in a fixed position. Actuation of the handle 26 can be used to remove the extension from the notch, thereby pivoting the engagement arms 28, 32 into contact with the locking arm 20 and permitting the locking arm 20 to move upward as the slips 12 move downward into the elevator body 10 for engagement with a tubular.

Figure 7:
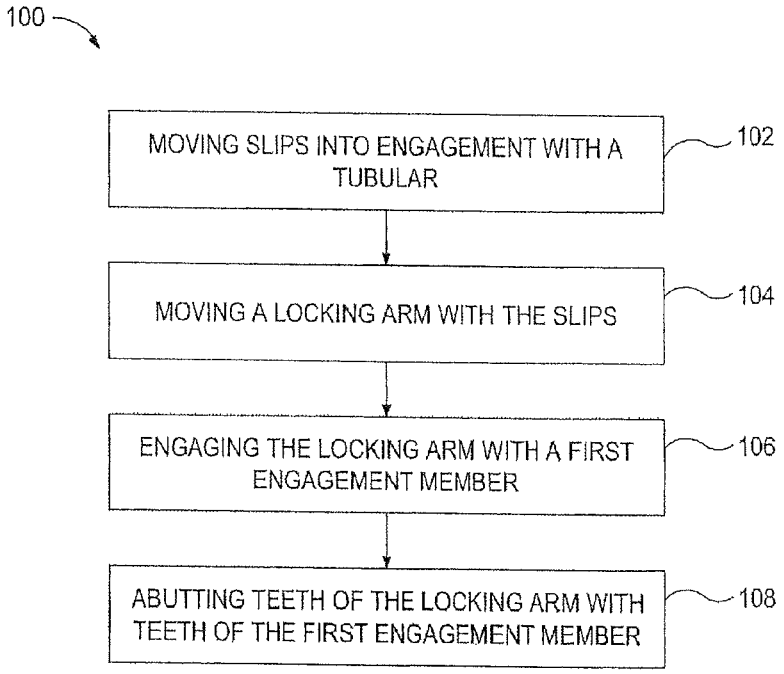
FIG. 7 illustrates a flowchart of a method for limiting slip movement in an elevator, according to one or more embodiments described.

FIG. 7 illustrates a flowchart of an exemplary method 100 for limiting movement of slips of an elevator relative to the elevator. The method 100 may proceed by operation of the elevator 1 and/or the apparatus 2 described above and may thus be best understood with reference thereto. The method 100 includes moving the slips into engagement with a tubular, as at 102. Moving the slips may require moving a locking arm therewith, as at 104. The method 100 further includes engaging the locking arm with a first engagement member, as at 106. The engagement at 106 between the locking arm and the first engagement member permits movement of the locking arm in a first direction and provides an end range for movement of the locking arm in a second direction. This limits movement of at least one of the slips relative to the elevator.

The method 100 may further include abutting the first plurality of teeth of the locking arm with the teeth of the first engagement member, as at 108. Additionally, the engaging at 106 may also include engaging teeth of the first engagement member with one or more of a first plurality of teeth of the locking arm. In an exemplary embodiment, the method 100 may also include engaging a second plurality of teeth of the locking arm with teeth of a second engagement member. As such, the abutting at 108 may proceed while the teeth of the second engagement member are at least partially disengaged from the second plurality of teeth of the locking arm, with the first and second pluralities of teeth being longitudinally offset. The method 100 may also include actuating an actuation member coupled with the first engagement member to move the engagement member from the disengaged position into the engaged position.

According to one or more aspects of the present disclosure, there is provided an apparatus to limit movement of gripping members relative to an elevator. In one or more embodiments, the apparatus includes a locking arm coupled to the gripping members, the locking arm having a set of teeth disposed longitudinally thereon, and a first engagement arm having a first set of complimentary teeth configured to engage with the set of teeth of the locking arm. In one or more embodiments, the first engagement arm may be moveable between a disengaged position, in which the first engagement arm and the locking arm may be relatively moveable, and an engaged position, in which the first engagement arm may allow the locking arm to move in a first direction but may prevent the locking arm from moving in a second direction by more than a selected distance. In one or more embodiments, the teeth of the locking arm may engage the first set of complimentary teeth of the first engagement arm when the first engagement arm is in the engaged position.

Further, according to one or more aspects of the present disclosure, there is provided an apparatus to grip a tubular. In one or more embodiments, the apparatus includes an annular body having a bore formed therethrough, in which the bore is configured to receive the tubular, a timing ring disposed within the annular body such that the timing ring may be movable axially within the bore of the annular body, the timing ring having a locking arm formed thereon, a plurality of slips engaged with the timing ring, the plurality of slips being moveable radially and axially between a disengaged position and an engaged position, and a first engagement arm configured to engage with the locking arm. In one or more embodiments, the plurality of slips and the tubular may be relatively moveable in the disengaged position, and the plurality of slips may be engaged with the tubular in the engaged position. In one or more embodiments, the first engagement arm may be movable between a disengaged position, in which the first engagement arm and the locking arm may be relatively moveable, and an engaged position, in which the first engagement arm may allow the locking arm to move in a downward direction but restrains the locking arm from moving in an upward direction by more than a selected distance.

Figure 8:
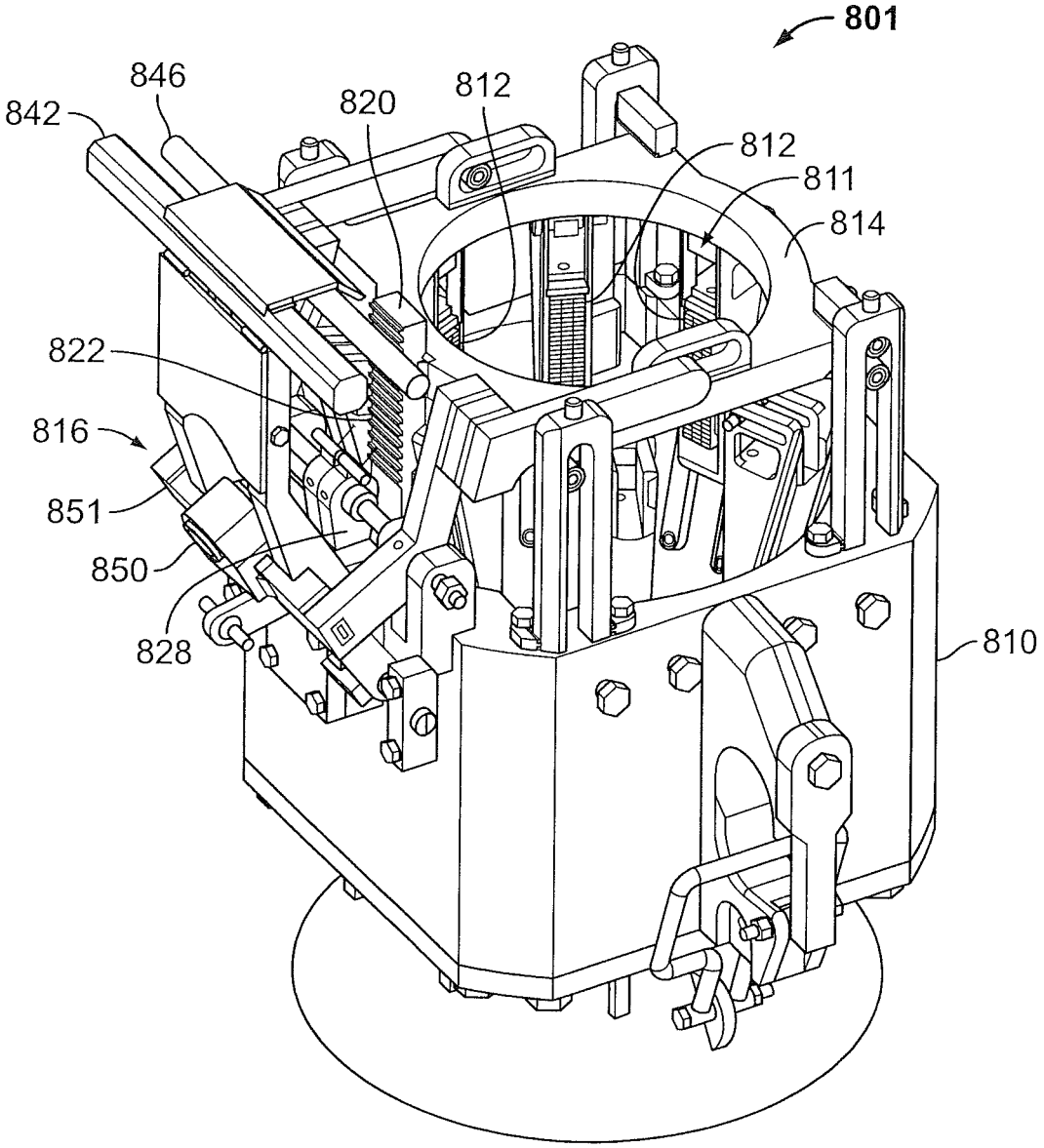
FIG. 8 illustrates a perspective view of an elevator, according to one or more embodiments described herein.

Referring to FIG. 8, an elevator 801 according to one or more embodiments is shown. In one or more embodiments, the elevator 801 may include a generally annular elevator body 810 having a longitudinal bore 811 formed therethrough to receive a tubular (not shown). The elevator 801 may have one or more gripping members or slips 812 disposed within the longitudinal bore 811 of the elevator body 810. The slips 812 may engage and disengage the tubular within the longitudinal bore 811 of the elevator body 810. Each of the slips 812 may include a body and/or retainer, which may include teeth, marking gripping surfaces, non-marking gripping surfaces, shoulders, combinations thereof, or may receive an insert including such teeth, surface, and/or shoulders for engagement with the tubular.

In one or more embodiments, the slips 812 may be moveable radially and/or longitudinally in the bore 811. For example, the slips 812 may be movable between a lowered, engaged position, in which the slips 812 may engage a tubular, and a raised, disengaged position, in which the slips 812 may allow independent movement between the elevator 801 and the tubular.

For example, an interior surface of the elevator body 810, with which the slips 812 may be coupled, may be a tapered surface. For example, in one or more embodiments, the interior surface of the elevator body 810 defining the longitudinal bore 811 may be tapered inward. As such, in one or more embodiments, the slips 812 may be disposed against the tapered surface, which may cause the slips 812 to move radially outward as the slips 812 are moved axially upward relative to the elevator body 810. Similarly, in one or more embodiments, the tapered surface may cause the slips 812 to move radially inward as the slips 812 are moved axially downward relative to the elevator body 810.

Further, in one or more embodiments, the interior surface of the elevator body 810 is not limited to necessarily being a tapered surface. Instead, in one or more embodiments, the interior surface of the elevator body 810, with which the slips 812 may be coupled, may be a non-tapered surface, and one or more surfaces of the slips 812 coupled to the inner surface of the elevator body 810 may comprise a taper. For example, in one or more embodiments, each of the slips 812 may comprise a generally wedge-shaped and/or triangular profile. As such, in one or more embodiments, the tapered surface of the slips 812 may be disposed against the non-tapered interior surface of the elevator body 810, which may cause the slips 812 to move radially outward as the slips 812 are moved axially upward relative to the elevator body 810. Similarly, in one or more embodiments, a tapered surface of the slips 812 may cause the slips 812 to move radially inward as the slips 812 are moved axially downward relative to the elevator body 810.

Furthermore, in one or more embodiments, the interior surface of the elevator body 810 defining the longitudinal bore 811 may be tapered inward, and a surface of the slips 812 coupled to the inner surface of the elevator body 810 may comprise a tapered surface. For example, in one or more embodiments, each of the slips 812 may be generally wedge-shaped and/or have a triangular profile. In one or more embodiments, the slips 812 may be moved between the engaged and disengaged positions manually or through any remote, hydraulic, pneumatic, or electrical devices and methods.

Further, the elevator 801 may also include a timing ring 814 coupled to the slips 812, such that movement of the timing ring 814 moves the slips 812. In one or more embodiments, the timing ring 814 may be directly connected to each of the slips 812 such that movement of the timing ring 814 (e.g., in an upward or downward axial direction relative to the elevator body 810) may be directly translated to the slips 812. The timing ring 814 may in turn be coupled to a yoke 816, which may be manually, remotely, etc. manipulated to raise and/or lower the timing ring 814 relative to the elevator body 810, thereby raising and/or lowering the slips 812. Further, as shown, the yoke 816 may also include a yoke crossbar 851 and a receptacle 850 configured to receive an elongate member (not shown). In one or more embodiments, the elongate member may be disposed within the receptacle 850, and the elongate member may be used to move the yoke 816, e.g., in a downward direction (e.g., manually). However, those having ordinary skill in the art will appreciate that, in one or more embodiments, the yoke 816 may be moved without the use of the elongate member disposed within the receptacle 850. Furthermore, in one or more embodiments, the elevator body 810 may also include a slip release arm 842 and a release bar 846, which will be described in further detail below.

The timing ring 814 may be of a generally annular shape, and a locking arm 820 may be formed on the timing ring 814. The locking arm 820 may include one or more sets of teeth. For example, as shown in FIG. 8, a set of teeth 822 is disposed on an outer longitudinal side of the locking arm 820. In addition, the elevator 801 may include an engagement arm 828 configured to engage with the locking arm 820 such that movement of the timing ring 814 in a direction that engages the slips 812 (e.g., a downward direction relative to the elevator body 810) is permitted, and movement of the timing ring 814 in a direction that disengages the slips 812 (e.g., an upward direction relative to the elevator body 810) is limited, as will be discussed further below. For example, in one or more embodiments, engagement between the locking arm 820 and the engagement arm may allow downward movement of the slips 812 and the timing ring 814 (e.g., into a lowered, engaged position) relative to the elevator body 810, while preventing upward movement of the slips 812 and the timing ring 814 (e.g., into a raised, disengaged position) relative to the elevator body 810. The engagement arm may also be referred to as a contacting, gripping, and/or movement-limiting member.

According to one or more aspects of the present disclosure, there may be included a second engagement arm coupled to the first engagement arm, the second engagement arm having a second set of complimentary teeth. In one or more embodiments, the second set of complimentary teeth of the second engagement arm may be longitudinally offset from the first set of complimentary teeth of the first engagement arm by a predetermined distance that is less than the length of a pitch of the first set of complimentary teeth, of the second set of complimentary teeth, or of both. Further, in one or more embodiments, the second set of complimentary teeth of the second engagement arm may be longitudinally offset from the first set of complimentary teeth of the first engagement arm by a distance of from ⅕ to ⅚ of a pitch of the first set of complimentary teeth, of the second set of complimentary teeth, or of both.

Further, one or more aspects of the present disclosure may be directed to a method to engage and/or disengage a tubular member. The method may include moving a plurality of slips from a disengaged position into an engaged position, in which the plurality of slips are coupled to a timing ring, the timing ring having a locking arm formed thereon, and engaging the locking arm with a first engagement arm, allowing movement of the plurality of slips in a downward direction towards the engaged position and limiting movement of the plurality of slips in an upward direction towards the disengaged position.

According to one or more aspects, engaging the locking arm with the first engagement arm may include engaging a first set of complimentary teeth of the first engagement arm with a set of teeth formed on the locking arm. The method may also include engaging a second set of complimentary teeth of a second engagement arm with the set of teeth formed on the locking arm, the second engagement arm coupled to the first engagement arm, and engaging the set of teeth of the locking arm with the first set of complimentary teeth of the first engagement arm, while the second set of complimentary teeth of the second engagement arm are at least partially disengaged from the set of teeth of the locking arm, the first set of complimentary teeth and the second set of complimentary teeth being longitudinally offset.

Figure 9B:
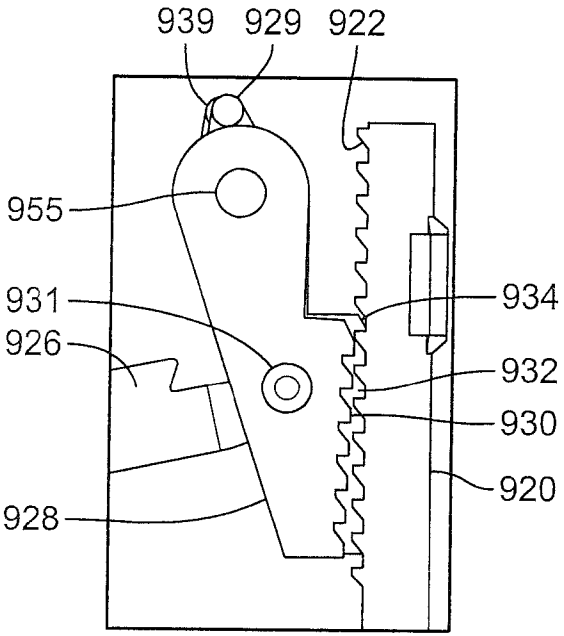
FIG. 9B illustrates a close-up view of a first engagement arm and a second engagement arm engaged with a locking arm, according to one or more embodiments disclosed herein.
Figure 9A:
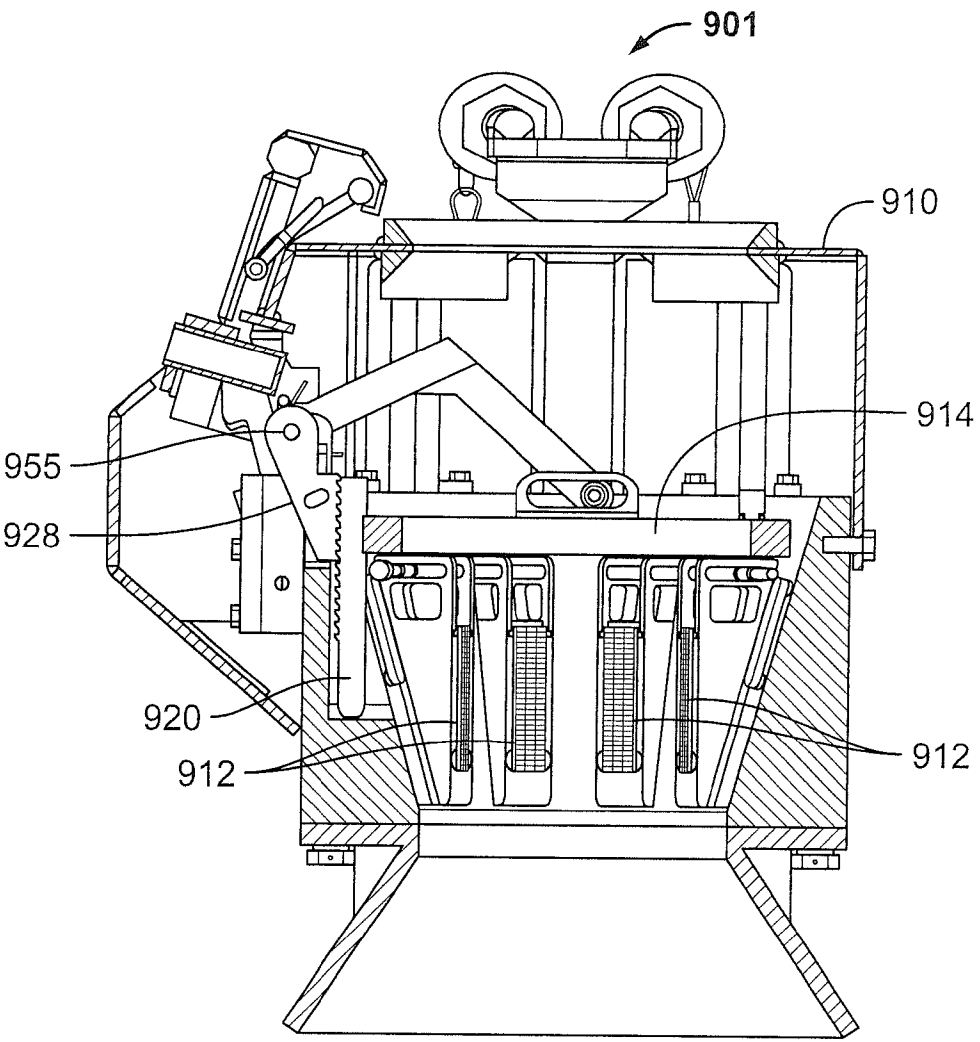
FIG. 9A illustrates a side cross-sectional view of an elevator, according to one or more embodiments described herein.
Figure 9C:
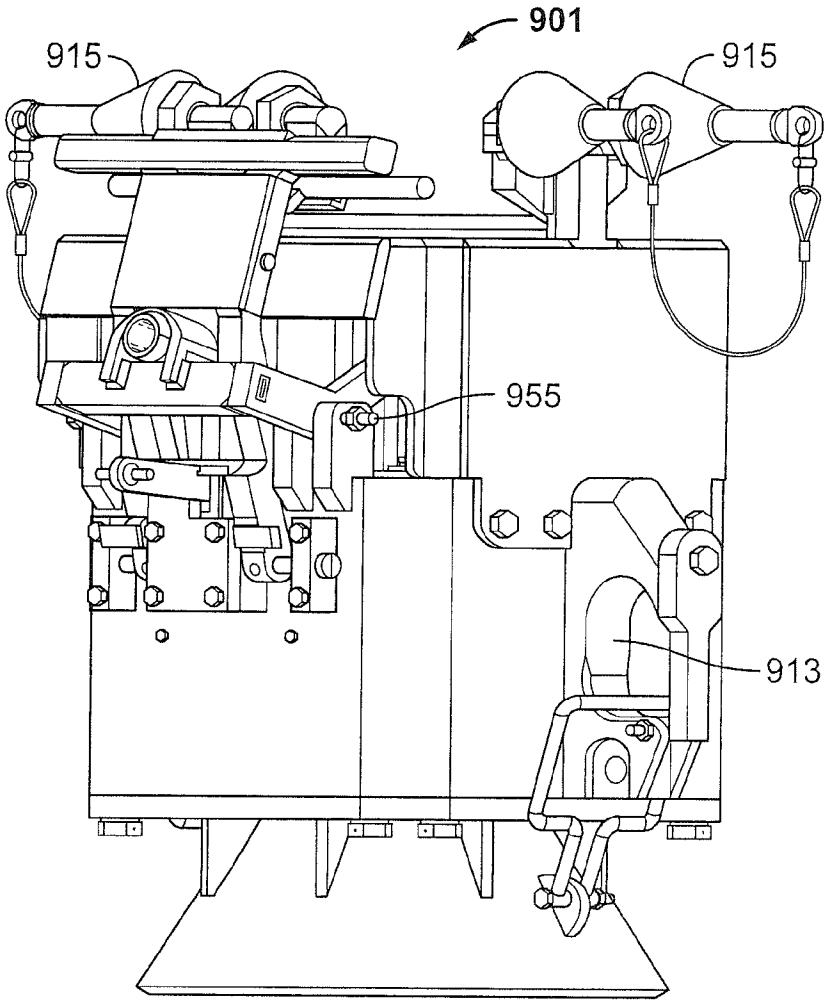
FIG. 9C illustrates a perspective view of an elevator, according to one or more embodiments described herein.

Referring now to FIGS. 9A-9C, multiple views of an elevator 901 having a plurality of slips 912 in an engaged position are shown in accordance with embodiments disclosed herein. For example, FIG. 9A illustrates a cross-sectional side view of the elevator 901 in accordance with embodiments disclosed herein. FIG. 9B illustrates a close-up view of a first engagement arm 928 and a second engagement arm 932 engaged with a locking arm 920 in accordance with embodiments disclosed herein. FIG. 9C illustrates a perspective view of the elevator 901 in accordance with embodiments disclosed herein.

As discussed above, in one or more embodiments, an engagement arm 928 may engage with the locking arm 920, which may be formed on a timing ring 914, such that movement in a direction that engages the slips 912 is allowed (e.g., a downward direction relative to a elevator body 910 of the elevator 901), but movement in a direction that disengages the slips 912 is limited (e.g., an upward direction relative to the elevator body 901). As shown in FIG. 9C, the elevator 901 may further include ears 913 and stabilizing members 915 for engaging bails (not shown) and orienting and/or moving the elevator 901.

In one or more embodiments, the engagement arm may include one or more engagement arms 928, 932, which may be coupled together. In one or more embodiments, the first engagement arm 928 may be directly coupled to the second engagement arm 932 such that the first engagement arm 928 and the second engagement arm 932 are in direct contact. However, in one or more embodiments, a gap or space may exist between the first engagement arm 928 and the second engagement arm 932. For example, in one or more embodiments, a disengagement member 926 may be disposed between the first engagement arm 928 and the second engagement arm 932. As shown, in FIG. 9B, a pin 931 may be disposed through both the first engagement arm 928 and the second engagement arm 932, coupling the first engagement arm 928 to the second engagement arm 932. In one or more embodiments, each of the first engagement arm 928 and the second engagement arm 932 may each have an elongate slot (not shown) formed therethrough, through which the pin 931 may be disposed. The elongate slot formed through each of the engagement arms 928, 932 may allow the first engagement arm 928 to be engaged with the locking arm, while the second engagement arm 932 is at least partially disengaged from the locking arm, or vice versa.

In one or more embodiments, the first engagement arm 928 may include a first set of complementary teeth 930. Further, in one or more embodiments, the second engagement arm 932 may include a second set of complementary teeth 934. The complimentary teeth 930, 934 of the first engagement arm 928 and the second engagement arm 932 may be formed and configured to engage a set of teeth 922 of the locking arm 920.

In one or more embodiments, the engagement arms 928, 932 may have staggered tooth profiles to allow minimal travel of the timing ring 914 and the slips 912 in the disengagement direction (e.g., in an upward direction). For example, the second set of complimentary teeth 934 formed on the second engagement arm 932 may be positioned below the corresponding teeth of the first set of complimentary teeth 930 formed on the first engagement arm 928 by a distance (e.g., the distance between corresponding points of two adjacent teeth) of about one-half the pitch of the complimentary teeth 930, 934. For example, the complimentary teeth 930, 934 may have a pitch of about 0.5 inches, and the second set of complimentary teeth 934 may be offset from the first set of complimentary teeth 930 by about 0.25 inches. Further, in one or more embodiments, the offset distance may range from a low of about ⅕, about ¼, or about ⅓ of the pitch to a high of about ¾, about ⅘, or about of the pitch.

Further, in one or more embodiments, the set of teeth 922 of the locking arm 920 may have a generally wedge-shaped and/or triangular profile, having an angled lower surface, and a generally straight and/or angled upper surface. The complementary teeth 930, 934 of the first and second engagement arms 928, 932 are shown having a corresponding, generally wedge-shaped and/or triangular profile with a angled upper surface and a generally straight and/or slightly angled lower surface. In one or more embodiments, the complimentary sets of teeth 930, 934 of the first and second engagement arms 928, 932 may include rounded or beveled tip sections. In other words, in one or more embodiments, a tip section of the complimentary sets of teeth 930, 934 of the first and second engagement arms 928, 932 are not limited to being necessarily wedge-shaped or having a triangular profile. Thus, while the complimentary sets of teeth 930, 934 of the engagement arms 928, 932 are in contact with the locking arm 920, movement of the locking arm 920 in the downward direction, corresponding to downward movement of the slips 912 to engage a tubular, may be permitted, as the set of teeth 922 of the locking arm 920 may slide over the complementary teeth 930, 934 of the engagement arms 928, 932 (e.g., due to the orientation and/or shape of the set of teeth 922 of the locking arm 920 as well as the orientation and/or shape of the complimentary sets of teeth 930, 934 of the engagement arms 928, 932).

The engagement arms 928, 932 may be pivotally coupled to the elevator body 910, such that the engagement arms 928, 932 may selectively engage with or disengage from the locking arm 920. Accordingly, in one or more embodiments, the engagement arms 928, 932 may be coupled to the elevator body 910 using a pivot pin 955 or the like. In one or more embodiments, the engagement arms 928, 932 can be linearly moveable, rather than, or in addition to, being pivotally movable. In other words, in one or more embodiments, each of the engagement arms 928, 932 may be moved away from the locking arm 920 in a linear fashion (e.g., without pivoting) to disengage the engagement arms 928, 932 from the locking arm 920. Further, in one or more embodiments, the engagement arms 928, 932 may pivot about the pivot pin 955, and the engagement anus 928, 932 may be disengaged from the locking arm 920 by pivoting the engagement arms 928, 932 about the pivot pin 955 such that the corresponding sets of teeth 930, 934 of the engagement arms 928, 932 are disengaged from the set of teeth 922 of the locking arm 920.

As shown in FIG. 9B, in one or more embodiments, the engagement arms 928, 932 may be biased towards an engaged position with the locking arm 920 by torsion springs 929, 939, respectively. In other words, in one or more embodiments, the torsion springs 929, 939 may be used to bias the engagement arms 928, 932 towards an engaged position with the locking arm 920 such that the timing ring 914 and the slips 912 may be allowed to move in a downward direction towards the engaged position, but may be limited in moving in an upward direction towards the disengaged position.

One or more aspects of the present disclosure may also include a disengagement member coupled to the first engagement arm, and a plate disposed on an outer surface of the elevator, in which a portion of the plate configured to engage with a portion of the disengagement member, and in which the disengagement member is engaged with the plate when the first engagement arm is in the disengaged position.

Further, one or more aspects of the present disclosure may include a yoke pivotably connected to the annular body, the yoke coupled to the timing ring such that downward movement of the yoke causes upward movement of the timing ring and of the plurality of slips towards the disengaged position. One or more aspects of the present disclosure may include a receptacle formed through the yoke, the receptacle configured to receive an elongate member.

A method to engage/disengage a tubular member, according to aspects disclosed herein, may also include disengaging the first engagement arm from the locking arm, allowing the plurality of slips to move upward into the disengaged position. Further, disengaging the first engagement arm from the locking arm may include moving a disengagement member in an outward direction, away from the locking arm, wherein moving the disengagement member in the outward direction disengages the first engagement atm from the locking arm, allowing the plurality of slips to move upward into the disengaged position.

Figure 10B:
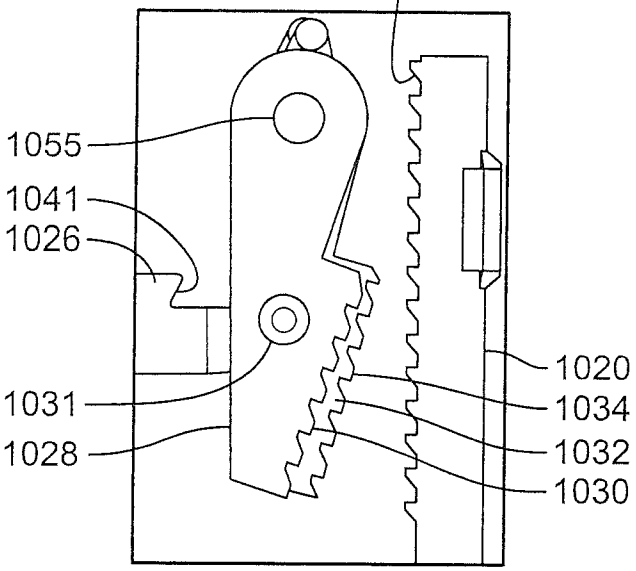
FIG. 10B illustrates a close-up view of a first engagement arm and a second engagement arm disengaged with a locking arm, according to one or more embodiments disclosed herein.
Figure 10A:
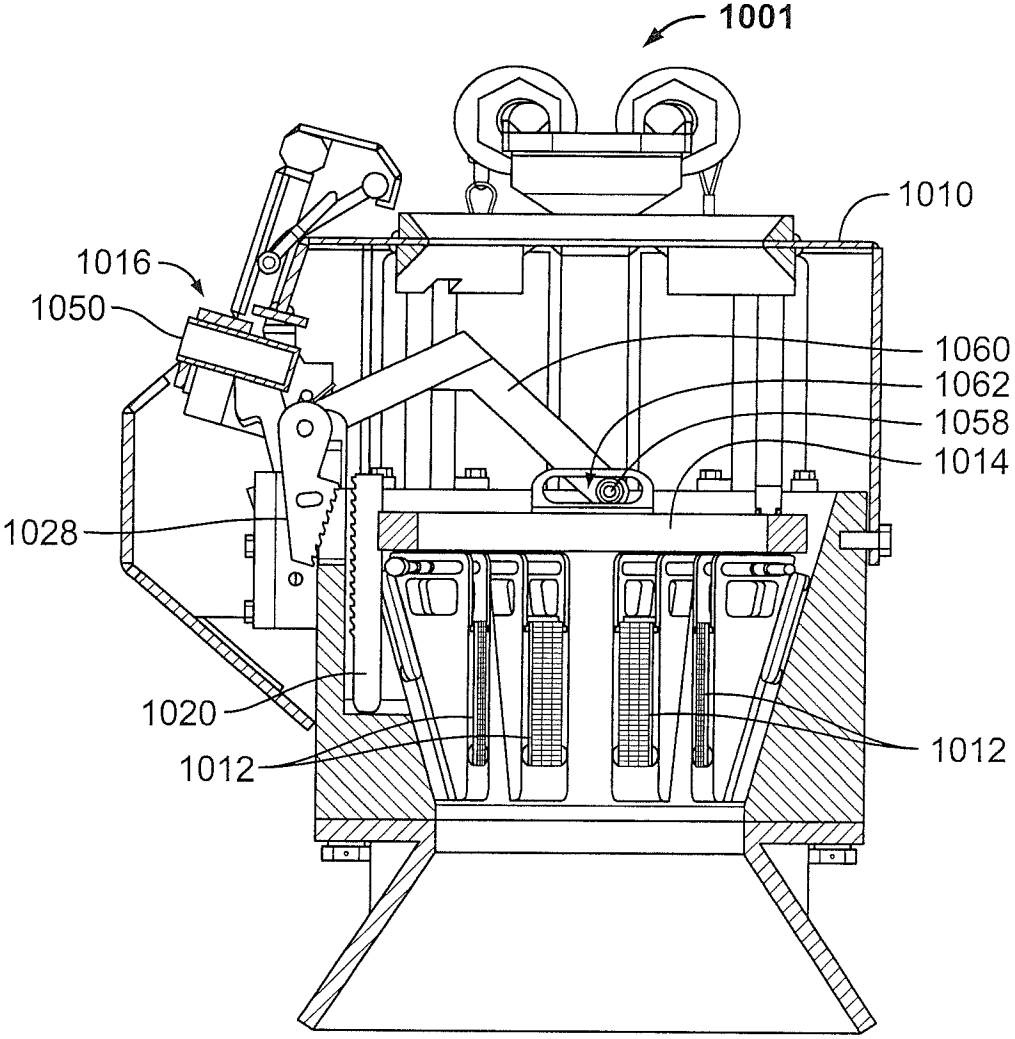
FIG. 10A illustrates a side cross-sectional view of an elevator, according to one or more embodiments described herein.
Figure 10D:
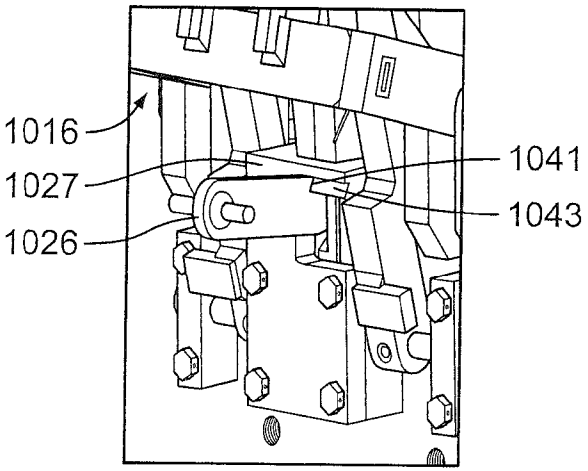
FIG. 10D illustrates a close-up view of a disengagement member, a plate 1027, and a yoke disposed on an elevator, according to one or more embodiments disclosed herein.
Figure 10C:
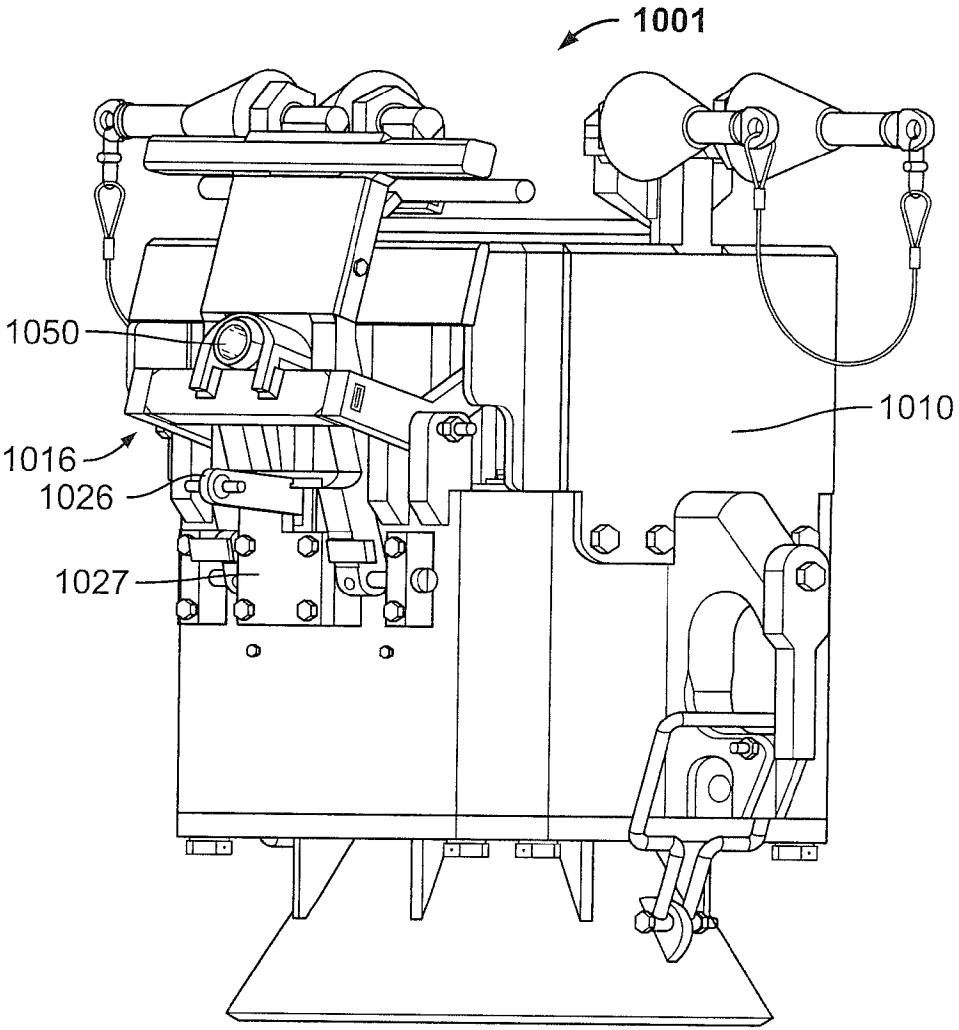
FIG. 10C illustrates a perspective view of an elevator, according to one or more embodiments described herein.

Referring now to FIGS. 10A-10D, multiple views of an elevator 1001 having engagement arms 1028, 1032 in a disengaged position while a plurality of slips 1012 are in an engaged position are shown in accordance with embodiments disclosed herein. For example, FIG. 10A illustrates a cross-sectional side view of the elevator 1001 in accordance with embodiments disclosed herein. FIG. 10B illustrates a close-up view of a first engagement arm 1028 and a second engagement arm 1032 disengaged with a locking arm 1020 in accordance with embodiments disclosed herein. FIG. 10C illustrates a perspective view of the elevator 1001 in accordance with embodiments disclosed herein. FIG. 10D illustrates a close-up view of a disengagement member 1026, a plate 1027, and a yoke 1016 disposed on the elevator 1001 in accordance with embodiments disclosed herein.

In one or more embodiments, the disengagement member 1026 may be coupled to the engagement arms 1028, 1032 such that engagement arms 1028, 1032 may be moved to a disengaged position with the locking arm 1020 when the disengagement member 1026 is pulled away from an elevator body 1010 of the elevator 1001 and engaged with a plate 1027. For example, in one or more embodiments, the disengagement member 1026 may be coupled to the engagement arms 1028, 1032 such that moving the disengagement member 1026 away from the locking arm 1020 causes the engagement arms 1028, 1032 to move away from (and disengage from) the locking arm 1020. In other words, in one or more embodiments, moving the disengagement member 1026 away from the locking arm 1020 may cause both a first set of complimentary teeth 1030 of the first engagement arm 1028 and a second set of complimentary teeth 1034 of the second engagement arm 1032 to disengage from a set of teeth 1022 of the locking arm 1020. In one or more embodiments, disengaging the complimentary sets of teeth 1030, 1034 of the engagement arms 1028, 1032 from the set of teeth 1022 of the locking arm 1020 may allow a timing ring 1014 coupled to the slips 1012, and the slips 1012 themselves, to move in an upward direction relative to the elevator body 1010 towards a disengaged position.

In one or more embodiments, a pin 1031 may be disposed through the first engagement arm 1028, the disengagement member 1026, and the second engagement arm 1032, coupling the first engagement arm 1028, the disengagement member 1026, and the second engagement arm 1032 to each other.

Further, in one or more embodiments, the engagement arms 1028, 1032 may be pivotally coupled to the elevator body 1010, such that the engagement arms 1028, 1032 may selectively engage with or disengage from the locking arm 1020. Accordingly, in one or more embodiments, the engagement arms 1028, 1032 may be coupled to the elevator body 1010 using a pivot pin 1055 or the like. In one or more embodiments, the engagement arms 1028, 1032 can be linearly moveable, rather than, or in addition to, being pivotally movable. In other words, in one or more embodiments, each of the engagement arms 1028, 1032 may be moved away from the locking arm 1020 in a linear fashion (e.g., without pivoting) to disengage the engagement arms 1028, 1032 from the locking arm 1020. Further, in one or more embodiments, the engagement arms 1028, 1032 may pivot about the pivot pin 1055, and the engagement arms 1028, 1032 may be disengaged from the locking arm 1020 by pivoting the engagement arms 1028, 1032 about the pivot pin 1055 such that the corresponding sets of teeth 1030, 1034 of the engagement arms 1028, 1032 are disengaged from the set of teeth 1022 of the locking arm 1020 (e.g., by moving the disengagement member 1026 away from the locking arm 1020 and away from the elevator body 1010).

As shown in FIG. 10D, in one or more embodiments, a plate 1027 may be disposed on an outer surface of the elevator body 1010. In one or more embodiments, the plate 1027 may have a groove 1043 formed thereon that is configured to engage a groove 1041 formed on the disengagement member 1026, as shown in FIGS. 10B and 10D. When the disengagement member 1026 is engaged with the plate 1027 (e.g., when the groove 1041 of the disengagement member 1026 is engaged with the groove 1043 of the plate 1027), the locking arm 1020, the timing ring 1014, and the slips 1012 may be free to move in an upward direction toward a disengaged position. In one or more embodiments, engagement between the disengagement member 1026 and the plate 1027 may allow the engagement arms 1028, 1032 to remain disengaged from the locking arm 1020 such that the complimentary sets of teeth 1030, 1034 of the engagement arms 1028, 1032 are disengaged from the set of teeth 1022 of the locking arm 1020. The slips 1012 may be raised to a disengaged position by inserting an elongate member (not shown) into a receptacle 1050 on the yoke 1016 and pushing in a downward direction on the elongate member. In one or more embodiments, the elongate member may be a round bar or any other elongate tubular member known in the art.

As shown in FIG. 10A, the elevator 1001 may include an arm 1060. In one or more embodiments, the arm 1060 may be angled and may be coupled to a movable portion of the elevator 1001, such as a yoke 1016. In one or more embodiments, the arm 1060 may include a pin 1058 disposed thereon, such as on a distal end of the arm 1060. As will be discussed further below, in one or more embodiments, the yoke 1016 may be moved in a downward direction, which may raise the timing ring 1014 and the slips 1012.

For example, as shown, a portion of the timing ring 1014 may include a slot 1062 formed thereon, the slot 1062 configured to receive the pin 1058 of the arm 1060. In one or more embodiments, the pin 1058 of the arm 1060 is engaged with and slidable within the slot 1062 formed on the timing ring 1014. As such, in one or more embodiments, moving the yoke 1016 in a downward direction (e.g., moving a distal end of the yoke 1016 in a downward direction relative to the elevator body 1010) may cause the pin 1058 of the arm 1060 to slide within the slot 1062 of the timing ring 1014 (e.g., towards the locking arm 1020 formed on the timing ring 1014). Further, in one or more embodiments, moving the yoke in the downward direction may cause the distal end of the arm 1060 having the pin 1058 disposed thereon to be raised in an upward direction (e.g., by way of the angle formed in the arm 1060). In one or more embodiments, raising the distal end of the arm 1060 having the pin 1058 disposed thereon may cause the timing ring 1014 to be raised in the upward direction because the pin 1058 is engaged with and slidable within the slot 1062 faulted on the timing ring 1014. Furthermore, raising the timing ring 1014 in the upward direction may cause the slips 1012 to be raised in the upward direction, which may cause the slips 1012 to disengage from a tubular member (not shown) disposed within the elevator 1001 (e.g., causing the slips 1012 to be moved into the disengaged position).

One or more aspects of the present disclosure may include a slip release arm pivotably connected to the annular body, the slip release arm configured to receive the yoke when the slips are in the disengaged position such that the yoke and the slips are locked in the disengaged position, a slip locking member pivotably connected to the slip release arm, the slip locking member configured to engage with a portion of the annular body, in which engagement between the slip locking member and the annular body prevents the slip release arm from releasing the yoke and prevents the slips from moving into the engaged position. One or more aspects of the present disclosure may also include a release bar pivotably connected to the slip release arm and engaged with the slip locking member, in which moving the release bar to a disengaged position disengages the slip locking member from the annular body and allows the slip release arm to release the yoke and allows the slips to move into the engaged position.

Figure 11B:
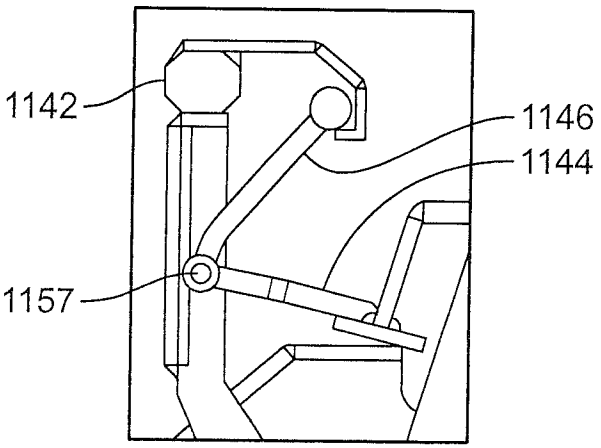
FIG. 11B illustrates a close-up view of a portion of an elevator having a slip release arm, a slip locking member, and a release bar, according to one or more embodiments disclosed herein.
Figure 11A:
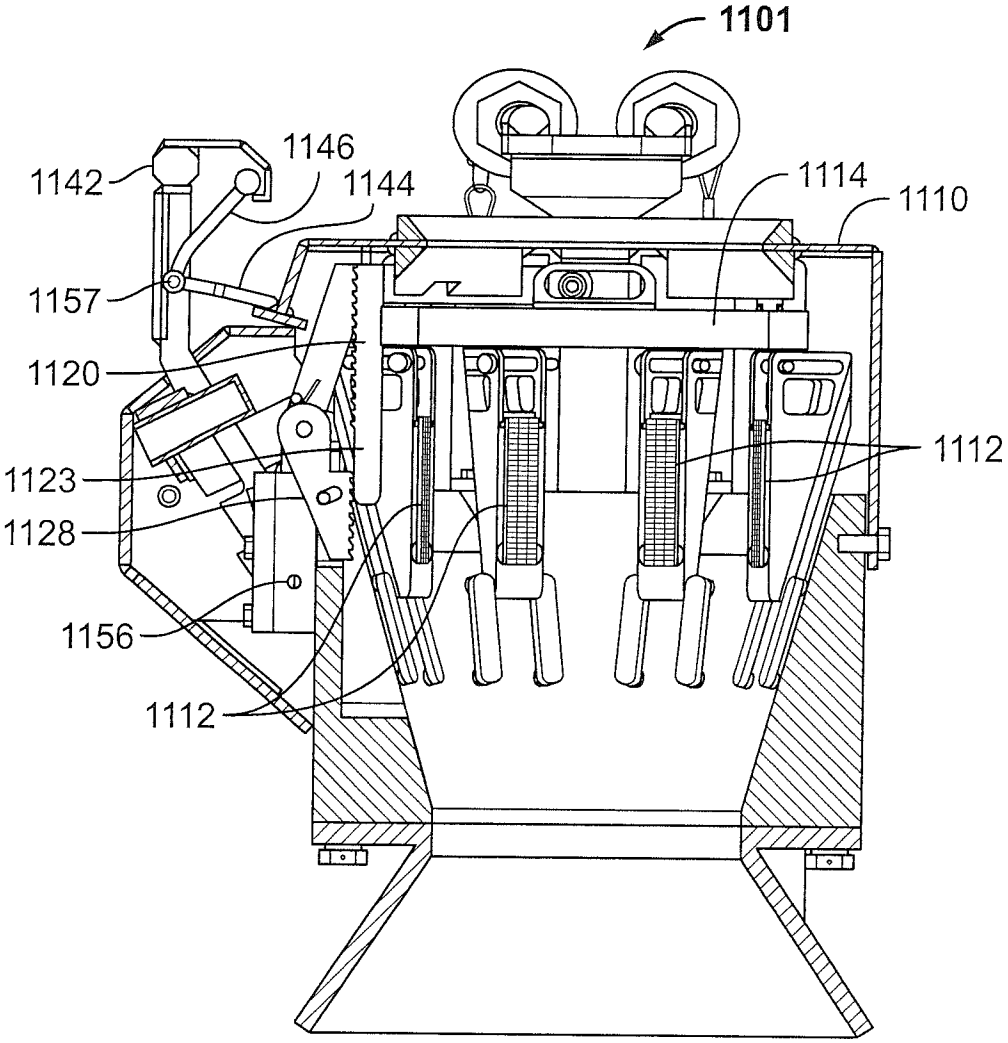
FIG. 11A illustrates a side cross-sectional view of an elevator, according to one or more embodiments described herein.
Figure 11D:
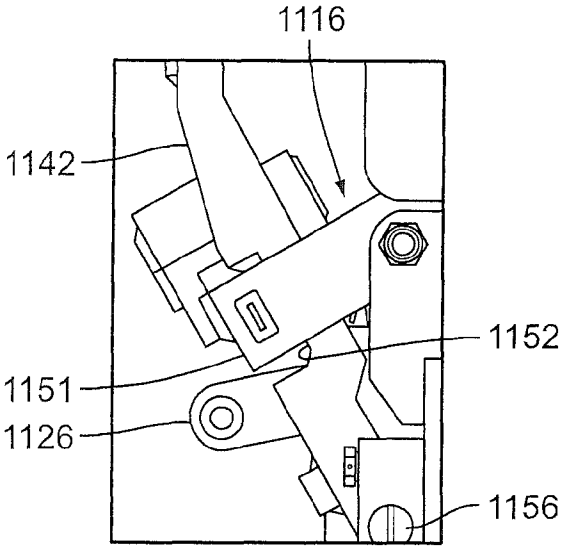
FIG. 11D illustrates a close-up view of a portion of an elevator having a yoke having a yoke crossbar, the slip release arm, and a disengagement member, according to one or more embodiments disclosed herein.
Figure 11C:
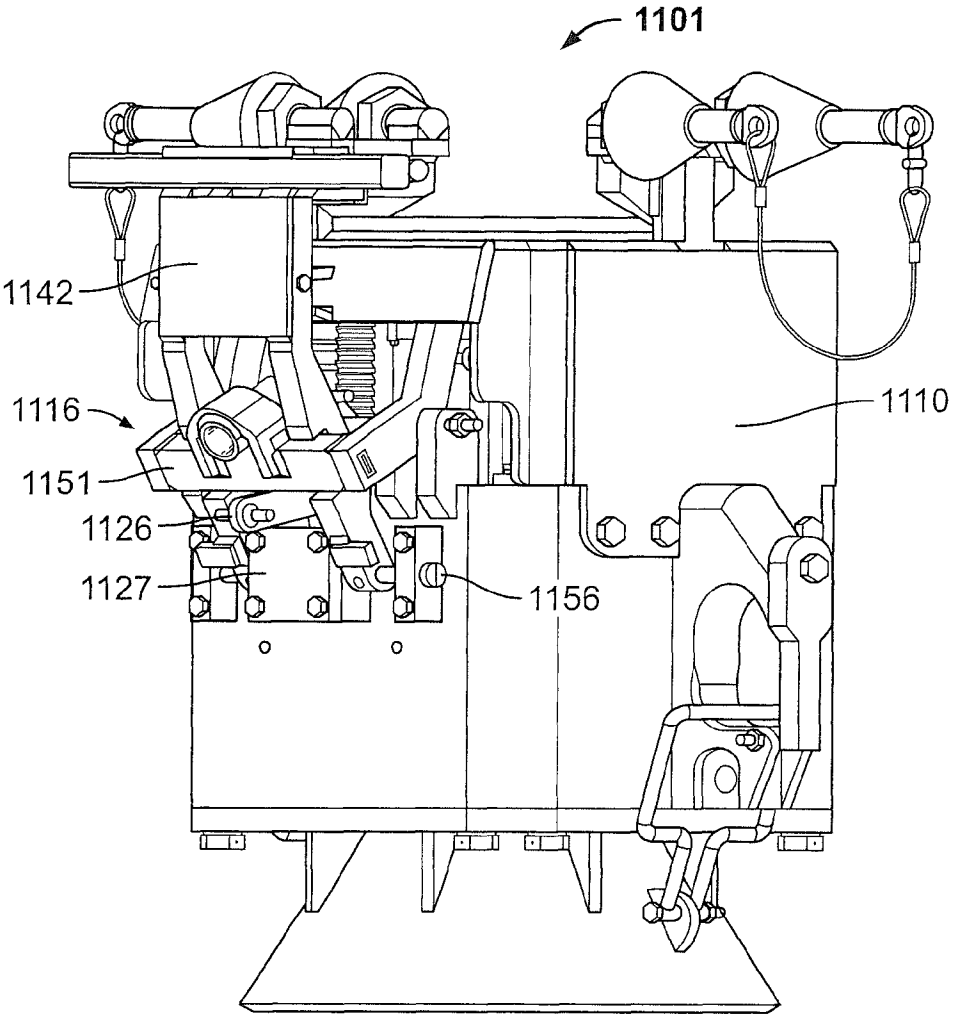
FIG. 11C illustrates a perspective view of an elevator, according to one or more embodiments described herein.

Referring now to FIGS. 11A-11D, multiple views of an elevator 1101 having a plurality of slips 1112 in a disengaged position that are locked in the disengaged position are shown in accordance with embodiments disclosed herein. For example, FIG. 11A illustrates a cross-sectional side view of the elevator 1101 in accordance with embodiments disclosed herein. FIG. 11B illustrates a close-up view of a portion of the elevator 1101 having a slip release arm 1142, a slip locking member 1144, and a release bar 1146 in accordance with embodiments disclosed herein. FIG. 11C illustrates a perspective view of the elevator 1101 in accordance with embodiments disclosed herein. FIG. 11D illustrates a close-up view of a portion of the elevator 1101 having a yoke 1116 including a yoke crossbar 1151, the slip release arm 1142, and a disengagement member 1126 in accordance with embodiments disclosed herein.

As shown in FIG. 11A, the elevator 1101 includes a plurality of slips 1112 and a timing ring 1114 coupled to the plurality of slips 1112 disposed within an elevator body 1110 of the elevator 1101. As shown, the timing ring 1114 includes a locking arm 1120 configured to engage with at least one engagement arm 1128. As discussed above, in one or more embodiments, the yoke 1116 may be moveable with respect to the elevator body 1110 and may be used to move the slips in an upward direction to a disengaged position.

In one or more embodiments, the yoke 1116 may be pivotably connected to the elevator body 1110 such that as the yoke 1116 is moved in one direction, the slips 1112 are moved in the opposite direction. For example, in one or more embodiments, as the yoke 1116 is moved in a downward direction relative to the elevator body 1110, the slips 1112 may in turn be moved in an upward direction relative to the elevator body 1110. In one or more embodiments, as the yoke 1116 is moved in the downward direction, the disengagement member 1126 may be disengaged from the plate 1127 by way of a yoke crossbar 1151. In other words, the yoke crossbar 1151 may be used to disengage the disengagement member 1126 from the plate 1127 by forcing the disengagement member 1126 in a downward direction such that the groove (e.g., the groove 1041 shown in FIGS. 10B and 10D) of the disengagement member 1126 no longer is engaged with the groove (e.g., the groove 1043 shown in FIG. 10D) of the plate 1127. Once the disengagement member 1126 is disengaged from the plate 1127, the engagement arms (one shown: 1128) may be biased towards the elevator body 1110 and the locking arm 1120 into an engaged position against a flat portion 1123 of the locking arm 1120, which may be formed on a portion of the locking arm 1120 below the set of teeth of the locking arm 1120.

Once the engagement arm 1128 is engaged with the flat portion 1123 of the locking arm 1120, the set of teeth of the locking arm 1120 may no longer be engaged with teeth formed on the engagement arm 1128. As such, the locking arm 1120 may be movable in both an upward and a downward direction relative to the elevator body 1110 and relative to the engagement arm 1128 because engagement between the teeth of the locking arm 1120 and the teeth of the engagement arm 1128 no longer limits relative movement of the locking arm 1120 in one direction (e.g., in the upward direction). In other words, engagement between the teeth of the engagement arm 1128 and the flat portion 1123 of the locking arm 1120 does not limit movement of the locking arm 1120 relative to the elevator body 1110 and relative to the engagement arm 1128 in one direction (e.g., in the upward direction).

In one or more embodiments, a slip release arm 1142 may be moved away from the elevator body 1110 and may engage with the yoke crossbar 1151 when the slips 1112 are fully raised and have reached the disengaged position. In one or more embodiments, a biasing member may be coupled to the slip release arm 1142, which may be used to move the slip release arm 1142 away from the elevator body 1110 when the slips 1112 are moved into the disengaged position. Further, as shown in FIG. 11D, a groove 1152 may be formed along a side portion of the slip release arm 1142. In one or more embodiments, the groove 1152 of the slip release arm 1142 may be configured to engage with the yoke crossbar 1151 and may lock the timing ring 1114 and the slips 1112 in the disengaged position. For example, as shown in FIG. 11C, the yoke crossbar 1151 of the yoke 1116 is engaged with the groove of the slip release arm 1142, which may lock the timing ring 1114 and the slips 1112 (shown in FIG. 11A) in a raised, disengaged position.

Referring back to FIG. 11D, in one or more embodiments, the slip release arm 1142 may be pivotably connected to the elevator body 1110 by way of a pivot pin 1156 such that the slip release arm 1142 may pivot with respect to the elevator body 1110. Further, as shown in FIG. 11B, in one or more embodiments, a slip locking member 1144 may be pivotably disposed on the slip release arm 1142 by way of a pivot pin 1157 such that the slip locking member 1144 may pivot with respect to the slip release arm 1142. The slip locking member 1144 may move into a locking position (e.g., the slip locking member 1144 may fall into the locking position) when the slips 1112 have reached the disengaged position. In one or more embodiments, the slip locking member 1144 may prevent the slips 1112 from setting accidentally when the slip locking member 1144 is in the locked position because the slip locking member 1144 engages a portion of the slip locking member 1144 against a portion of the elevator body 1110 when the slip locking member 1144 is in the locked position. Engagement of the slip locking member 1144 with the portion of the elevator body 1110, as shown in FIG. 11A, may prevent the slip release arm 1142 from moving towards the elevator body 1110 because the slip locking member 1144 may also be engaged with the slip release 1142 and may hold the slip release arm 1142 at a fixed position relative to the elevator body 1110.

In addition, in one or more embodiments, a release bar 1146 may be pivotably disposed on the slip release arm 1142 using the pivot pin 1157, the release bar 1146 coupled to the slip locking member 1144 such that moving the release bar 1146 towards the slip release arm may move the slip locking member 1144 upward to an unlocked position. For example, the release bar 1146 may include a protrusion (not shown) extending from the release bar 1146 at about 90 degrees and configured to engage a bottom surface of the slip locking member 1144. In one or more embodiments, the protrusion engaging the slip locking member 1144 may cause the slip locking member 1144 to pivot about the pivot pin 1157 as the release bar 1146 is pivoted about the pivot pin 1157. Moving the slip locking member 1144 upward to the unlocked position may cause the slip locking member 1144 to disengage from the portion of the elevator body 1110, which may allow the timing ring 1114 and the slips 1112 to move back into the engaged position.

Figure 12B:
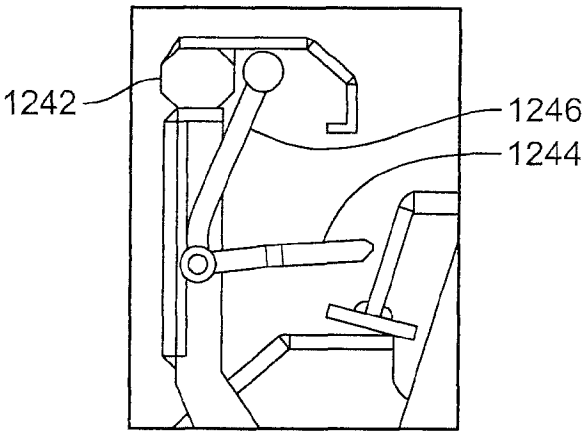
FIG. 12B illustrates a close-up view of a portion of an elevator having a slip release arm, a slip locking member, and a release bar, according to one or more embodiments disclosed herein.
Figure 12A:
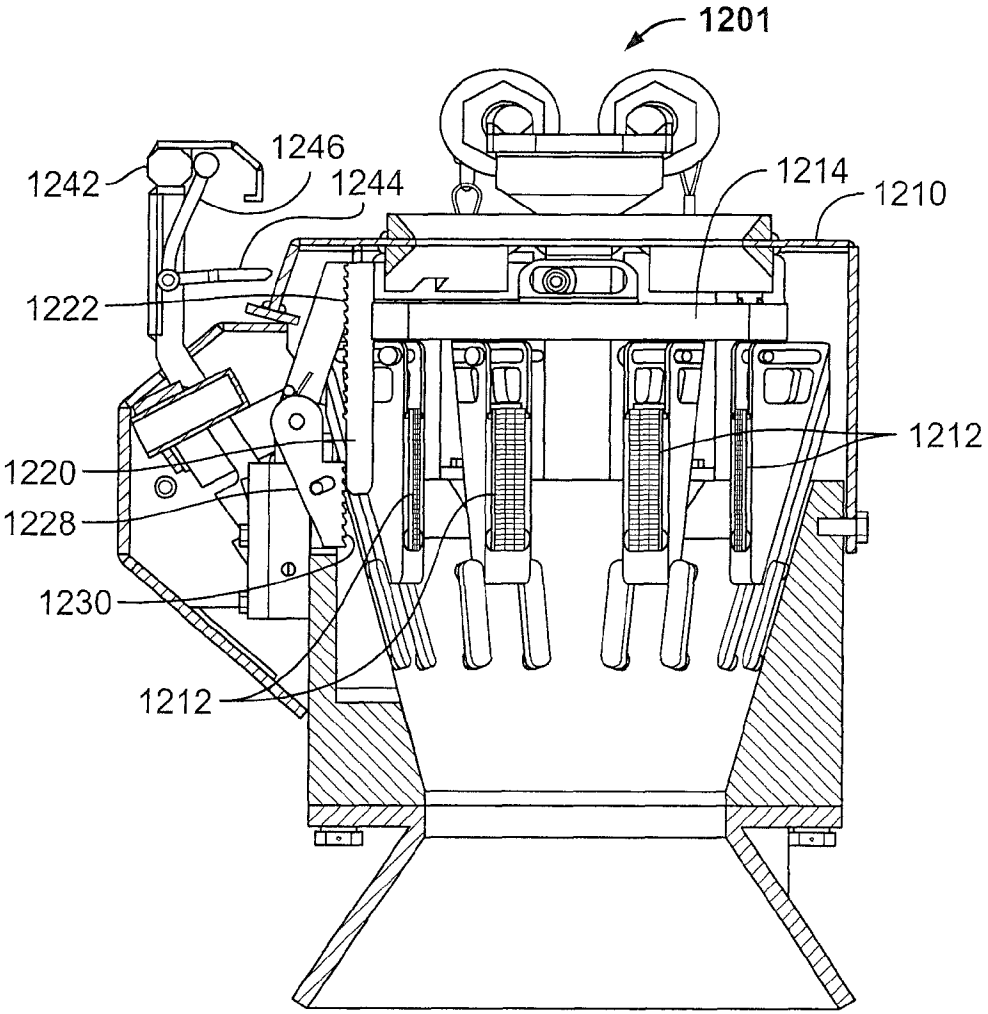
FIG. 12A illustrates a side cross-sectional view of an elevator, according to one or more embodiments described herein.
Figure 12C:
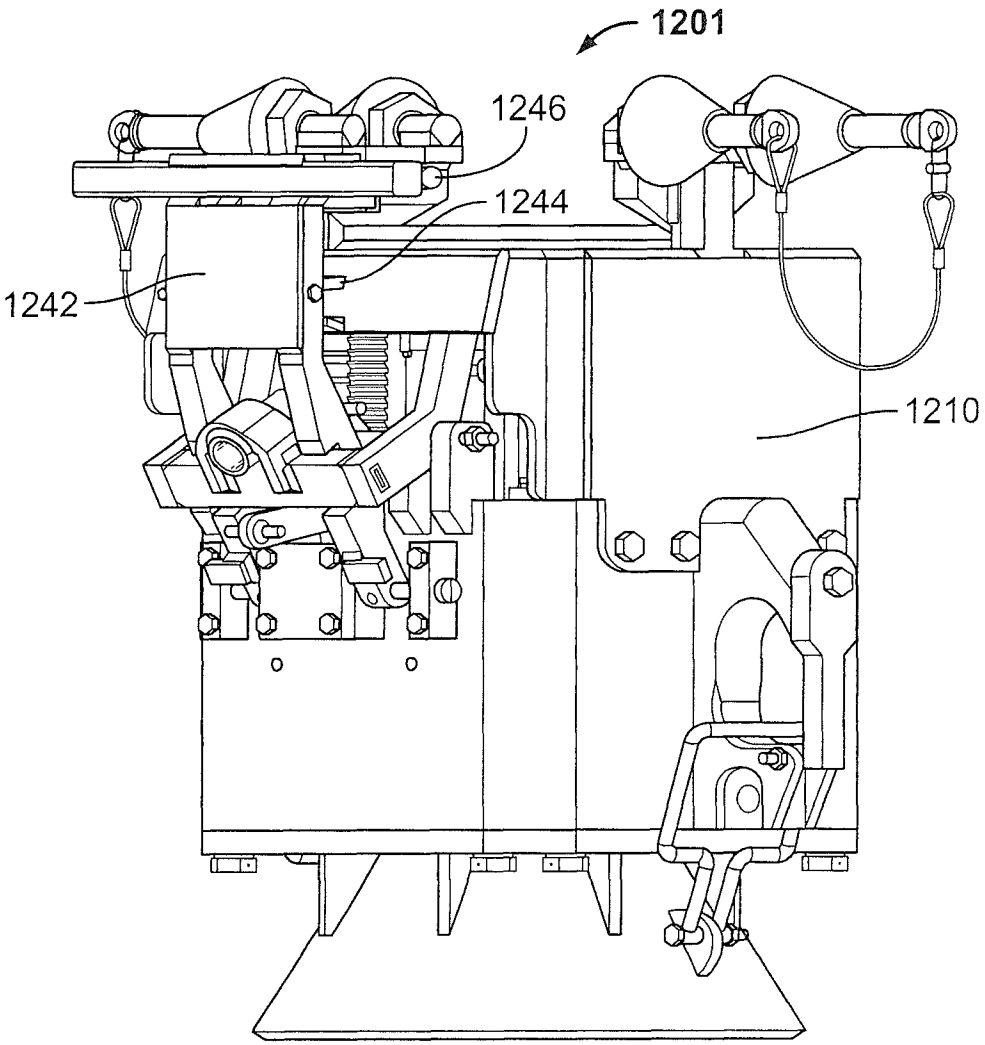
FIG. 12C illustrates a perspective view of an elevator, according to one or more embodiments described herein

Referring now to FIGS. 12A-12C, multiple views of an elevator 1201 having a plurality of slips 1212 in a disengaged position that are released to be set in an engaged position are shown in accordance with embodiments disclosed herein. For example, FIG. 12A illustrates a cross-sectional side view of the elevator 1201 in accordance with embodiments disclosed herein. FIG. 12B illustrates a close-up view of a portion of the elevator 1201 having a slip release arm 1242, a slip locking member 1244, and a release bar 1246 in accordance with embodiments disclosed herein. FIG. 12C illustrates a perspective view of the elevator 1201 in accordance with embodiments disclosed herein.

As shown in FIG. 12A, the elevator 1201 includes a plurality of slips 1212 and a timing ring 1214 coupled to the plurality of slips 1212 disposed within an elevator body 1210 of the elevator 1201. As shown, the timing ring 1214 includes a locking arm 1220 configured to engage with at least one engagement arm 1228. As discussed above, in one or more embodiments, the yoke 1216 may be moveable with respect to the elevator body 1210 and may be used to move the slips in an upward direction to a disengaged position.

In one or more embodiments, the slip locking member 1244 may be disengaged by pulling the release bar 1246, which may be coupled to the slip locking member 1244, such that when the release bar 1246 is pulled (e.g., towards a distal end of the slip release arm 1242), the slip locking member 1244 may be moved upward to an unlocked position. As discussed above, moving the slip locking member 1244 upward to the unlocked position may cause the slip locking member 1244 to disengage from the portion of the elevator body 1210, which may allow the timing ring 1214 and the slips 1212 to move back into the engaged position.

As such, in one or more embodiments, the slips 1212 may be unlocked from the disengaged position by pulling the release bar 1246 against the slip release arm 1242 to move the slip locking member 1244 to an unlocked position. This may allow the slips to be moved in a downward direction towards an engaged position. In one or more embodiments, pushing the slip release arm 1242 towards the elevator body 1210 may unlock the yoke 1216 from the locked position, which may allow the slips 1212 to be moved in the downward direction relative to the elevator body 1210. As the slips 1212 move in the downward direction relative to the elevator body 1210, the timing ring 1214 may also move in the downward direction relative to the elevator body 1210 because the timing ring 1214 may be coupled to the slips 1212. As the timing ring 1214 moves in the downward direction relative to the elevator body 1210, the locking arm 1220 formed on the timing ring 1214 may move relative to the elevator body 1210 and the engagement arm 1228. As such, a set of complimentary teeth (one shown: 1230) of the engagement arms (one shown: 1228) may then re-engage the teeth 1222 of the locking arm 1220 and may allow the timing ring 1214 and the slips 1212 to be lowered towards the engaged position, and may limit upward movement of the timing ring 1214 and the slips 1212 towards the disengaged position.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An apparatus to limit movement of gripping members relative to an elevator, comprising:

a locking arm coupled to the gripping members, the locking arm having a set of teeth disposed longitudinally thereon;

a first engagement arm having a first set of complimentary teeth configured to engage with the set of teeth of the locking arm, wherein the first engagement arm is moveable between a disengaged position, in which the first engagement arm and the locking arm are relatively moveable, and an engaged position, in which the first engagement arm allows the locking arm to move in a first direction but prevents the locking arm from moving in a second direction by more than a selected distance;

a disengagement member coupled to the first engagement arm; and a plate disposed on an outer surface of the elevator, wherein the teeth of the locking arm engage the first set of complimentary teeth of the first engagement arm when the first engagement arm is in the engaged position, wherein a portion of the plate is configured to engage with a portion of the disengagement member, and wherein, when the disengagement member is engaged with the plate, the first engagement arm is maintained in the disengaged position.

2. The apparatus of claim 1, further comprising:

a second engagement arm coupled to the first engagement arm, the second engagement arm having a second set of complimentary teeth.

3. The apparatus of claim 2, wherein the second set of complimentary teeth of the second engagement arm are longitudinally offset from the first set of complimentary teeth of the first engagement arm by a predetermined distance that is less than the length of a pitch of at least one of the first set of complimentary teeth and the second set of complimentary teeth.

4. The apparatus of claim 2, wherein the second set of complimentary teeth of the second engagement arm are longitudinally offset from the first set of complimentary teeth of the first engagement arm.

5. The apparatus of claim 2, wherein:

the second set of complimentary teeth are configured to engage with the set of teeth of the locking arm, the second engagement arm is moveable between a disengaged position, in which the second engagement arm and the locking arm are relatively moveable, and an engaged position, in which the second engagement arm allows the locking arm to move in the first direction but prevents the locking arm from moving in the second direction by more than the selected distance, and when the disengagement member is engaged with the plate, the second engagement arm is maintained in the disengaged position.

6. An apparatus to grip a tubular, comprising:

an annular body having a bore formed therethrough, wherein the bore is configured to receive the tubular;

a timing ring disposed within the annular body such that the timing ring is movable axially relative to the bore of the annular body, the timing ring having a locking arm formed thereon;

a plurality of slips engaged with the timing ring, the plurality of slips being moveable radially and axially between a disengaged position and an engaged position, wherein the slips and the tubular are relatively moveable in the disengaged position, and wherein the plurality of slips are engaged with the tubular in the engaged position; and a first engagement arm configured to engage with the locking arm; and a yoke pivotably connected to the annular body, wherein the first engagement arm is movable between a disengaged position, in which the first engagement arm and the locking arm are relatively moveable, and an engaged position, in which the first engagement arm allows the locking arm to move in a first direction but restrains the locking arm from moving in a second direction by more than a selected distance, and wherein the yoke is coupled to the timing ring such that movement of the yoke in the first direction causes movement of the timing ring and of the plurality of slips in the second direction towards the disengaged position.

7. The apparatus of claim 6, further comprising:

a disengagement member coupled to the first engagement arm; and a plate disposed on an outer surface of the elevator, wherein a portion of the plate is configured to engage with a portion of the disengagement member, wherein, when the disengagement member is engaged with the plate, the first engagement arm is maintained in the disengaged position.

8. The apparatus of claim 6, further comprising:

a second engagement arm coupled to the first engagement arm, wherein the second engagement arm is configured to engage with the locking arm.

9. The apparatus of claim 8, wherein:

the locking arm has a set of teeth disposed longitudinally thereon;

the first engagement arm has a first set of complimentary teeth configured to engage with the set of teeth of the locking arm; and the second engagement arm has a second set of complimentary teeth configured to engage with the set of teeth of the locking arm.

10. The apparatus of claim 9, wherein the second set of complimentary teeth of the second engagement arm are longitudinally offset from the first set of complimentary teeth of the first engagement arm by a predetermined distance that is less than the length of a pitch of at least one of the first set of complimentary teeth and the second set of complimentary teeth.

11. The apparatus of claim 9, wherein the second set of complimentary teeth of the second engagement arm are longitudinally offset from the first set of complimentary teeth.

12. The apparatus of claim 6, further comprising:

a slip release arm pivotably connected to the annular body, the slip release arm configured to receive the yoke when the slips are in the disengaged position such that the yoke and the plurality of slips are locked in the disengaged position.

13. The apparatus of claim 12, further comprising:

a slip locking member pivotably connected to the slip release arm, the slip locking member configured to engage with a portion of the annular body, wherein engagement between the slip locking member and the annular body prevents the slip release arm from releasing the yoke and prevents the plurality of slips from moving into the engaged position.

14. The apparatus of claim 13, further comprising:

a release bar pivotably connected to the slip release arm and engaged with the slip locking member, wherein moving the release bar to a disengaged position disengages the slip locking member from the annular body and allows the slip release arm to release the yoke and allows the plurality of slips to move into the engaged position.

15. The apparatus of claim 6, wherein the yoke comprises:

a receptacle formed therethrough, the receptacle configured to receive an elongate member.

16. A method to engage and disengage a tubular member, comprising:

moving a plurality of slips from a disengaged position into an engaged position, in which the plurality of slips engage the tubular member, wherein the plurality of slips are coupled to a timing ring, the timing ring having a locking arm formed thereon; and engaging the locking arm with a first engagement arm, allowing movement of the plurality of slips in a first direction towards the engaged position and limiting movement of the plurality of slips in a second direction towards the disengaged position, wherein engaging the locking arm with the first engagement arm comprises:

engaging a first set of complimentary teeth of the first engagement arm with a set of teeth formed longitudinally on the locking arm;

engaging the locking arm with a second engagement arm, allowing movement of the plurality of slips in the first direction towards the engaged position and limiting movement of the plurality of slips in the second direction towards the disengaged position, wherein engaging the locking arm with the second engagement arm comprises:

engaging a second set of complimentary teeth of the second engagement arm with the set of teeth of the locking arm, wherein the second engagement arm is coupled to the first engagement arm, and wherein the first set of complimentary teeth and the second set of complimentary teeth are longitudinally offset such that when the first set of complimentary teeth of the first engagement arm are engaged with the set of teeth of the locking arm, the second set of complimentary teeth of the second engagement arm are at least partially disengaged from the set of teeth of the locking arm.

17. The method of claim 16, further comprising:

disengaging the first engagement arm and the second engagement arm from the locking arm, allowing the plurality of slips to move in the second direction into the disengaged position.

18. The method of claim 17, wherein disengaging the first engagement arm and second engagement arm from the locking arm comprises:

moving a disengagement member in an outward direction, away from the locking arm, wherein moving the disengagement member in the outward direction disengages the first engagement arm and the second engagement aim from the locking arm, allowing the slips to move in the second direction into the disengaged position.

19. An apparatus to grip a tubular, comprising:

an annular body having a bore formed therethrough, wherein the bore is configured to receive the tubular;

a timing ring disposed within the annular body such that the timing ring is movable axially relative to the bore of the annular body, the timing ring having a locking arm formed thereon, wherein the locking arm has a set of teeth disposed longitudinally thereon;

a plurality of slips engaged with the timing ring, the plurality of slips being moveable radially and axially between a disengaged position and an engaged position, wherein the slips and the tubular are relatively moveable in the disengaged position, and wherein the plurality of slips are engaged with the tubular in the engaged position; and a first engagement arm configured to engage with the locking arm, the first engagement arm having a first set of complimentary teeth configured to engage with the set of teeth of the locking arm;

a second engagement arm configured to engage with the locking arm, the second engagement arm having a second set of complimentary teeth configured to engage with the set of teeth of the locking arm, wherein the first engagement arm is movable between a disengaged position, in which the first engagement arm and the locking arm are relatively moveable, and an engaged position, in which the first engagement arm allows the locking arm to move in a first direction but restrains the locking arm from moving in a second direction by more than a selected distance, wherein the second engagement arm is movable between a disengaged position, in which the second engagement arm and the locking arm are relatively moveable, and an engaged position, in which the second engagement arm allows the locking arm to move in the first direction but restrains the locking arm from moving in the second direction by more than the selected distance, wherein the first set of complimentary teeth are configured to engage the set of teeth of the locking arm when the first engagement arm is in the engaged position, wherein the second set of complimentary teeth are configured to engage the set of teeth of the locking arm when the second engagement arm is in the engaged position, and wherein the first set of complimentary teeth and the second set of complimentary teeth are longitudinally offset from each other.

* * * * *